US009448031B2

(12) United States Patent
Wijegunawardana

(10) Patent No.: US 9,448,031 B2
(45) Date of Patent: Sep. 20, 2016

(54) SHUTTLECOCK LAUNCHING METHOD AND APPARATUS

(71) Applicant: Mahesh Wijegunawardana, Gahanna, OH (US)

(72) Inventor: Mahesh Wijegunawardana, Gahanna, OH (US)

( * ) Notice: Subject to any disclaimer, the term of this patent is extended or adjusted under 35 U.S.C. 154(b) by 0 days.

(21) Appl. No.: 13/957,393

(22) Filed: Aug. 1, 2013

(65) Prior Publication Data

US 2014/0261364 A1 Sep. 18, 2014

Related U.S. Application Data

(60) Provisional application No. 61/801,117, filed on Mar. 15, 2013.

(51) Int. Cl.

| | |
|---|---|
| ***F41B 4/00*** | (2006.01) |
| ***A63B 69/40*** | (2006.01) |
| ***A63B 67/18*** | (2016.01) |
| ***F41J 9/30*** | (2006.01) |
| ***F41J 9/32*** | (2006.01) |

(52) U.S. Cl.

CPC ..... *F41B 4/00* (2013.01); *A63B 67/18* (2013.01); *A63B 69/406* (2013.01); *F41J 9/30* (2013.01); *F41J 9/32* (2013.01)

(58) Field of Classification Search

CPC ..... A63B 69/40; A63B 69/0017; F41B 4/00
USPC ..... 124/78, 51.1, 65, 45
See application file for complete search history.

(56) References Cited

U.S. PATENT DOCUMENTS

| | | | | |
|---|---|---|---|---|
| 4,424,969 | A * | 1/1984 | Dumas | 473/419 |
| 5,464,208 | A * | 11/1995 | Pierce | 473/451 |
| 6,273,315 | B1 * | 8/2001 | McGuinness et al. | 227/18 |
| 6,752,138 | B2 | 6/2004 | Taryoto | |
| 7,553,244 | B2 * | 6/2009 | York | 473/438 |
| 8,261,729 | B2 | 9/2012 | Laszlo et al. | |
| 2007/0062509 | A1 * | 3/2007 | Campo et al. | 124/73 |
| 2009/0283088 | A1 * | 11/2009 | Laszlo et al. | 124/78 |

FOREIGN PATENT DOCUMENTS

JP 2008212440 A 9/2008

* cited by examiner

*Primary Examiner* — Gene Kim
*Assistant Examiner* — Jeffrey Vanderveen
(74) *Attorney, Agent, or Firm* — Miracle IP; Bryce D. Miracle

(57) ABSTRACT

A method and apparatus for launching shuttlecocks at different frequencies, trajectories, speeds, spins, and shot types, thereby providing simulated shots for use in practice for badminton players and trainers. The shuttlecock launching apparatus having a dual pivoting launch assembly for providing various launch paths and trajectories, first and second launching wheels for imparting a forward motion to a shuttlecock, and a shuttlecock holding and transfer assembly for transferring a single shuttlecock from a holding area to a launch point near the first and second launching wheels in a controlled and consistent manner.

15 Claims, 36 Drawing Sheets

SHUTTLECOCK LAUNCHING METHOD AND APPARATUS

CROSS-REFERENCE TO RELATED APPLICATION

This application is based upon, and claims the priority filing date, of the previously-filed, copending U.S. Provisional patent application entitle "SHUTTLECOCK LAUNCHING APPARATUS" filed Mar. 15, 2013, Ser. No. 61/801,117.

BACKGROUND

The present invention relates to a method and apparatus for the launching of badminton shuttlecocks.

Many sports utilize machines for performing a competitive movement in order to provide practice for its players. For instance, a wide variety of ball throwing machines employ counter rotating wheels that have been utilized in the past for activities such as tennis, ping pong, and baseball. These machines automatically launch the balls at different speeds, styles, trajectories. The use of the machines permits a player to practice without requiring a partner or, allows an instructor to dedicate more of his or her time and focus on a player or group of players being trained, and allows an instructor to provide instruction on more than one court at the same time.

However, in the game of badminton, the shape of a shuttlecock is much more complex and is naturally inconsistent with that of a spherical ball. A shuttlecock is a high-drag projectile with an open conical shape. The cone is formed from approximately sixteen overlapping feathers, usually goose or duck and from the left wing only, embedded into a rounded cork base. The cork is covered with thin leather. The shuttlecock's shape makes it extremely aerodynamically stable. These unique aerodynamic properties cause it to fly differently than balls used in most racquet sports; in particular, the feathers create much higher drag, causing the shuttlecock to decelerate more rapidly than a ball. Shuttlecocks have a much higher top speed compared to other racquet sports. Regardless of initial orientation, it will turn to fly cork first, and remain in the cork-first orientation.

It has been proposed in the art to provide machines for launching shuttlecocks. However, due to the irregularities of the shuttlecock's quality and shape, it has been a challenge to provide an apparatus that is reliable, consistent, accurate, low maintenance, and cost efficient.

The present invention provides a device for reducing these problems. The difficulties inherent in the art are therefore overcome in a way which is simple and efficient, while providing better and more advantageous results.

SUMMARY

The present invention is a method and apparatus for the launching of badminton shuttlecocks at different frequencies, trajectories, speeds, spins, and shot types. More particularly, the invention is an easy to use, reliable, accurate and programmable shuttlecock launcher notwithstanding the varying quality and condition of the shuttlecock, for purposes of recreation, training aid, teaching aid, and shuttlecock speed testing.

The invention is the first of its kind to provide a shuttlecock launching apparatus that is simple and cost efficient, yet reliable, consistent, and most importantly accurate. In accordance with the invention, a method and apparatus is provided for the launching of badminton shuttlecocks at different frequencies, trajectories, shot types, spins and speeds, thereby providing simulated shots for use in practice for badminton players. The shuttlecock launching apparatus comprises a dual pivoting launch assembly having a launch point for launching shuttlecocks at a plurality of launch angles, first and second launching wheels mounted on the dual pivoting launch assembly, a shuttlecock holding and transfer assembly mounted on the dual pivoting launch assembly adjacent to the first and second launching wheels. The holding and transfer assembly comprises a holding area for receiving and holding a single shuttlecock and a shuttlecock transfer mechanism for transferring the shuttlecock from the holding area to the launch point which provides the ability to receive, hold, and transferring on queue a single shuttlecock to the launch point. The launch angle provided by the dual pivoting launch assembly coordinated with the variable rotational speeds of the first and second launch wheels provides a trajectory, velocity and launching of the shuttlecock.

A programmable control system controls the operation of the apparatus including all components thereof. The control system controls the operation of both the dual pivoting launch assembly and independent wheel velocities of the first and second launching wheels, trajectory, and/or spin to a shuttlecock for launching the shuttlecock from the apparatus toward an intended location or for a desired shot type. The control system further controls the coordinated operation and timing of the holding and transfer assembly to control when each launch takes place by placing the shuttlecock to the launch point. The launch angle and launch path, independent wheel velocities, and operation of the holding and transfer assembly are predetermined by parameters defining the path of a launched shuttlecock for an intended simulated shot.

In one version, the holding and transfer assembly further comprises a pair of horizontally disposed guidance rails for guiding the shuttlecock to the launch point and beyond in an upright position while the shuttlecock transfer mechanism transfers the shuttlecock from the holding area to the launch point, whereby ensuring accurate delivery and accuracy of the launch.

In another version, the apparatus further comprises first and second fenders adjacent to the corresponding first and second launching wheels, which provide a barrier to prevent the shuttlecock from contacting the first and second wheels before the shuttlecock reaches the launch point during the transfer of the shuttlecock.

In yet another version, the holding area of the holding and transfer assembly comprises a rear fixed portion and a front gate portion. The front gate portion is configured to move in a path of motion that has at least an open position and a closed position. The gate portion in the closed position and the rear fixed portion collectively form a cone shaped holding area adapted to receive and hold a single shuttlecock. In this version, the shuttlecock transfer mechanism comprises a rear thrust member for providing forward motion to the shuttlecock. The rear thrust member is configured to provide the forward motion simultaneously as the front gate portion moves into the open position, thereby transferring the shuttlecock from the holding area to the launch point.

In another version of the invention, the shuttlecock launcher may include a shuttlecock distribution system. The shuttlecock distribution system comprises a shuttlecock storage container capable of housing a stack of one or more shuttlecocks; an apparatus for applying a controlled force on the stack of one or more shuttlecocks providing a downward movement of the one or more shuttlecocks within the shuttlecock storage device; a shuttlecock filter located at the bottom opening of the shuttlecock storage container for receiving and separating the bottom shuttlecock from the stack of one or more shuttlecocks as the stack of one or more shuttlecocks moves downward within the shuttlecock storage device; and a vertical shuttlecock transfer assembly for transferring a single shuttlecock from the shuttlecock filter to the holding area in a controlled manner. The shuttlecock distribution system is controlled by a programmable control system for coordinated operation and timing sequence of the shuttlecock distribution system components, which serves to separate and distribute to the holding area a single shuttlecock from a stack of one or more shuttlecocks in a coordinated manner. The shuttlecock distribution system can operate in a parallel and simultaneous manner with the controlled operation of the shuttlecock launching apparatus, thus reducing time between launches and providing the availability of increased shot frequency for top level players.

In an a version of the invention, a method for launching a single shuttlecock may be utilized which comprises: providing a dual pivoting launch assembly providing a plurality of launch angles; providing a first and second launching wheels; providing a holding and transfer assembly comprising: a holding area for receiving and holding a single shuttlecock, and a shuttlecock transfer mechanism for transferring the shuttlecock from the holding area to the first and second launching wheels; loading a single shuttlecock within the holding area of the holding and transfer assembly; moving the dual pivoting launch assembly to a desired launch angle; shuttlecock transfer mechanism transferring the single shuttlecock to the first and second launching wheels; and first and second launching wheels launching the single shuttlecock along a launch path.

In another version of the invention, a method for separating a single bottom shuttlecock from a stack of one or more shuttlecocks may be utilized which comprises: providing a shuttlecock filter comprising a narrowing diameter forming a filter channel; receiving the bottom of the stack of one or more shuttlecocks within the filter; and applying a force to the top of the stack of one or more shuttlecocks, wherein imparting movement of the stack towards and the bottom shuttlecock through the narrowing diameter until the top of the bottom shuttlecock passes through the shuttlecock filter, thereby separating the bottom shuttlecock from the remaining stack of one or more shuttlecocks.

The shuttlecock launcher can simulate practically any type of badminton shot to substantially all locations of a practice area or badminton court and even shots that are out of the court. Furthermore, the shuttlecock launcher can perform tricks shots by providing unique angles, and differences in wheel rotation and wheel velocities. Although simple and cost efficient, the new shuttlecock launcher remains reliable, consistent, and accurate.

Still other benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
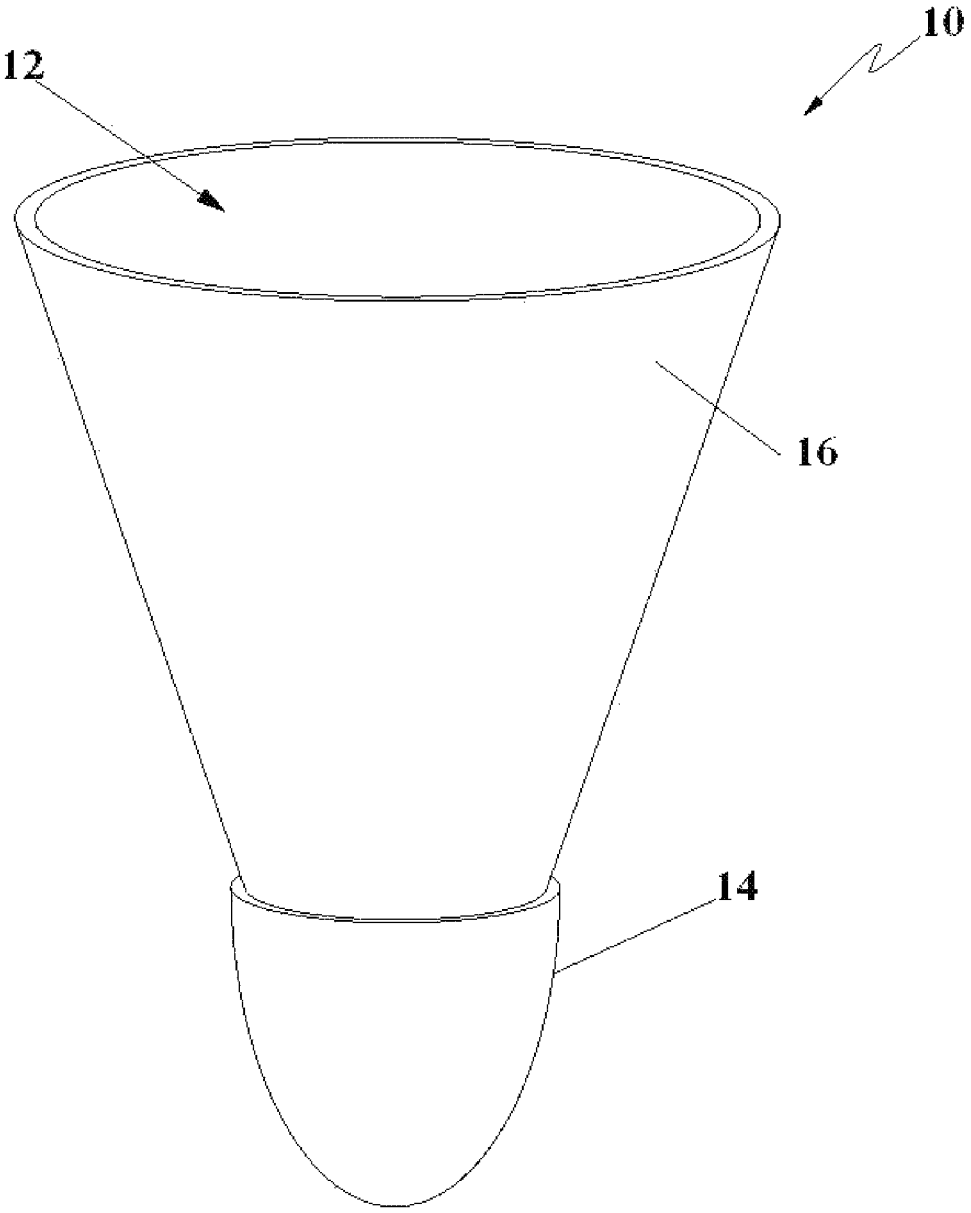
FIG. 1 is a perspective view of a shuttlecock.

Referring now to the drawings wherein the showings are for purposes of illustrating preferred versions of the invention only and not for purposes of limiting the same, the present invention is a reliable and yet cost effective shuttlecock launcher that has the ability to simulate realistic shots at different frequencies, trajectories, speeds, spins, and shot types.

The following detailed description is of the best currently contemplated modes of carrying out exemplary versions of the invention. The description is not to be taken in the limiting sense, but is made merely for the purpose of illustrating the general principles of the invention, since the scope of the invention is best defined by the appended claims.

Various inventive features are described below that can each be used independently of one another or in combination with other features.

The present invention is described below with respect to a launched shuttlecock. FIG. 1 generally depicts the overall general shape of a shuttlecock 10 used in the game of badminton. Shuttlecocks generally have an open conical shape 12. Traditionally, the conical shape 12 is formed from a plurality of overlapping feathers, usually goose or duck and from the left wing only, embedded into a rounded cork base 14. Shuttlecocks break easily and often need to be replaced several times during a game. For this reason, synthetic shuttlecocks have been developed that replace the feathers with a plastic skirt. Shuttlecocks can easily be stacked fitting one on top of the other for storage and other needs. The shuttlecock launcher is capable of launching both real and synthetic shuttlecocks.

Figure 2A:
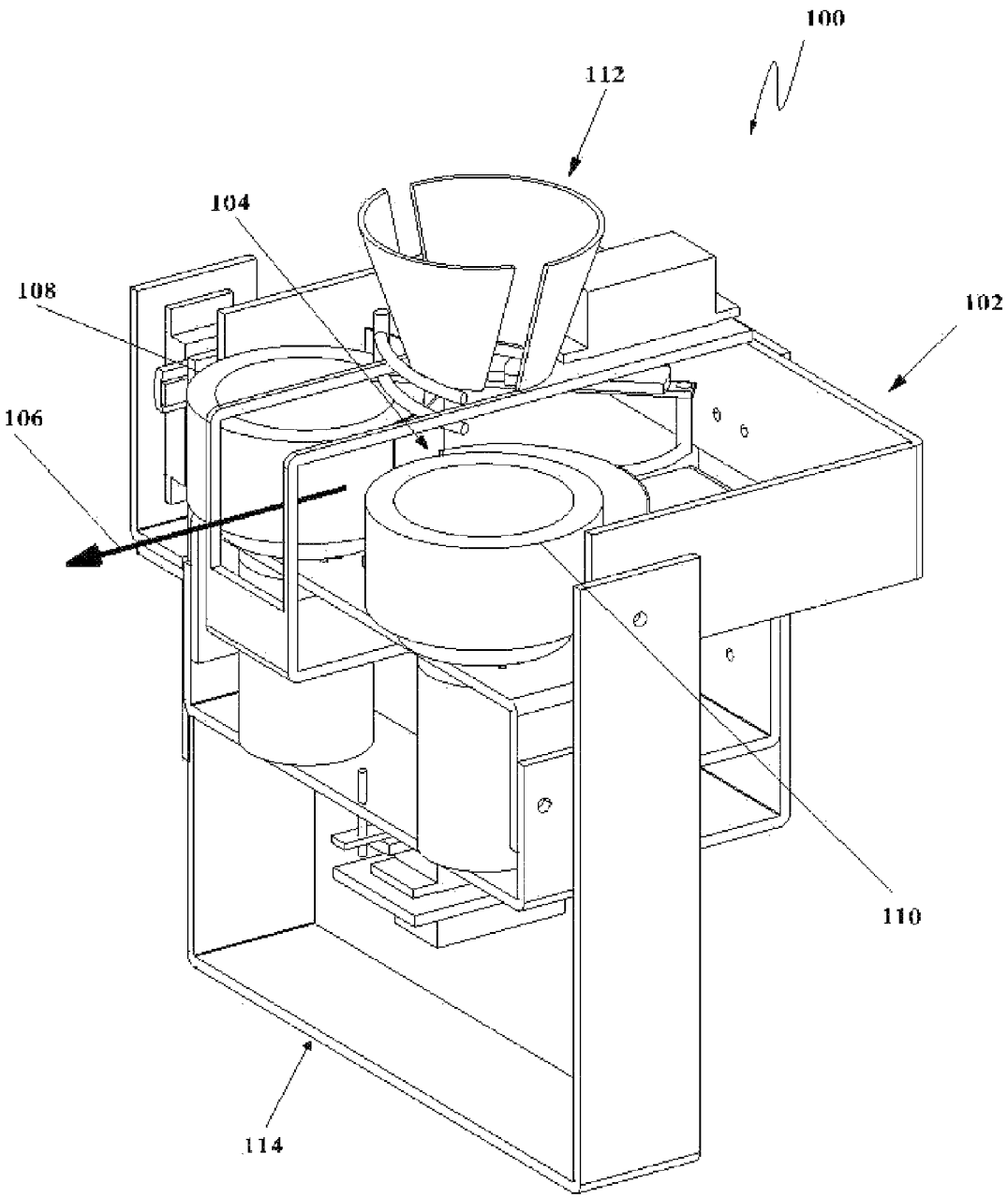
FIG. 2A is a front, side perspective view of a version of the present invention.
Figure 2B:
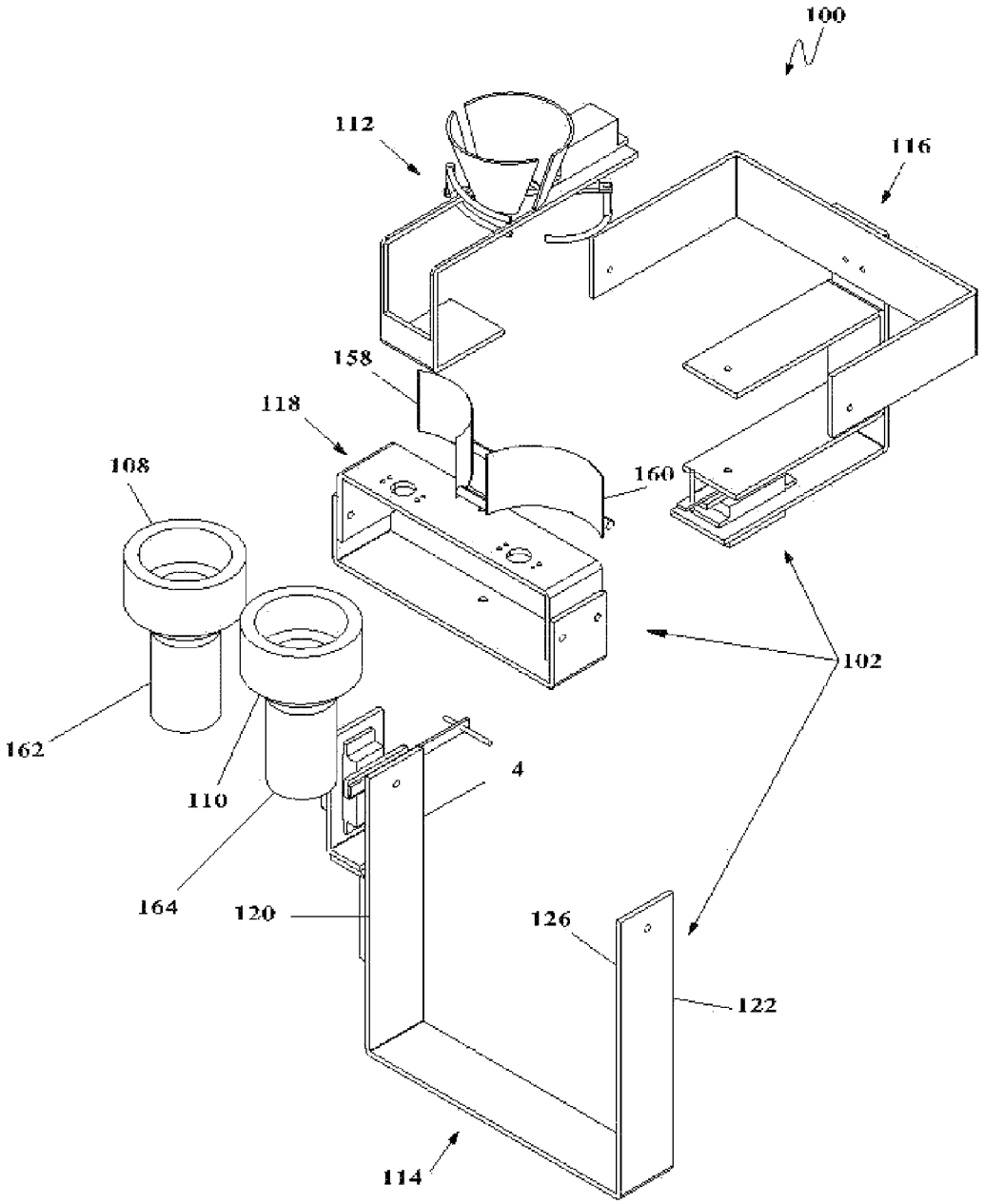
FIG. 2B is an exploded view of the version shown in FIG. 2A.

As a general overview, FIG. 2A and exploded view FIG. 2B depict a version of the shuttlecock launcher comprising a shuttlecock launching assembly generally indicated as numeral 100. The shuttlecock launcher 100 comprises a dual pivoting launch assembly 102 having a launch point 104, for adjusting the angular position of the launch path 106 and trajectory of a shuttlecock 10, a first and second launching wheels 108 and 110 for launching a shuttlecock, and a shuttlecock holding and transfer assembly generally depicted as 112 for receiving, holding and transferring a single shuttlecock to the first and second launching wheels 108, 110 in a controlled manner.

Figure 3:
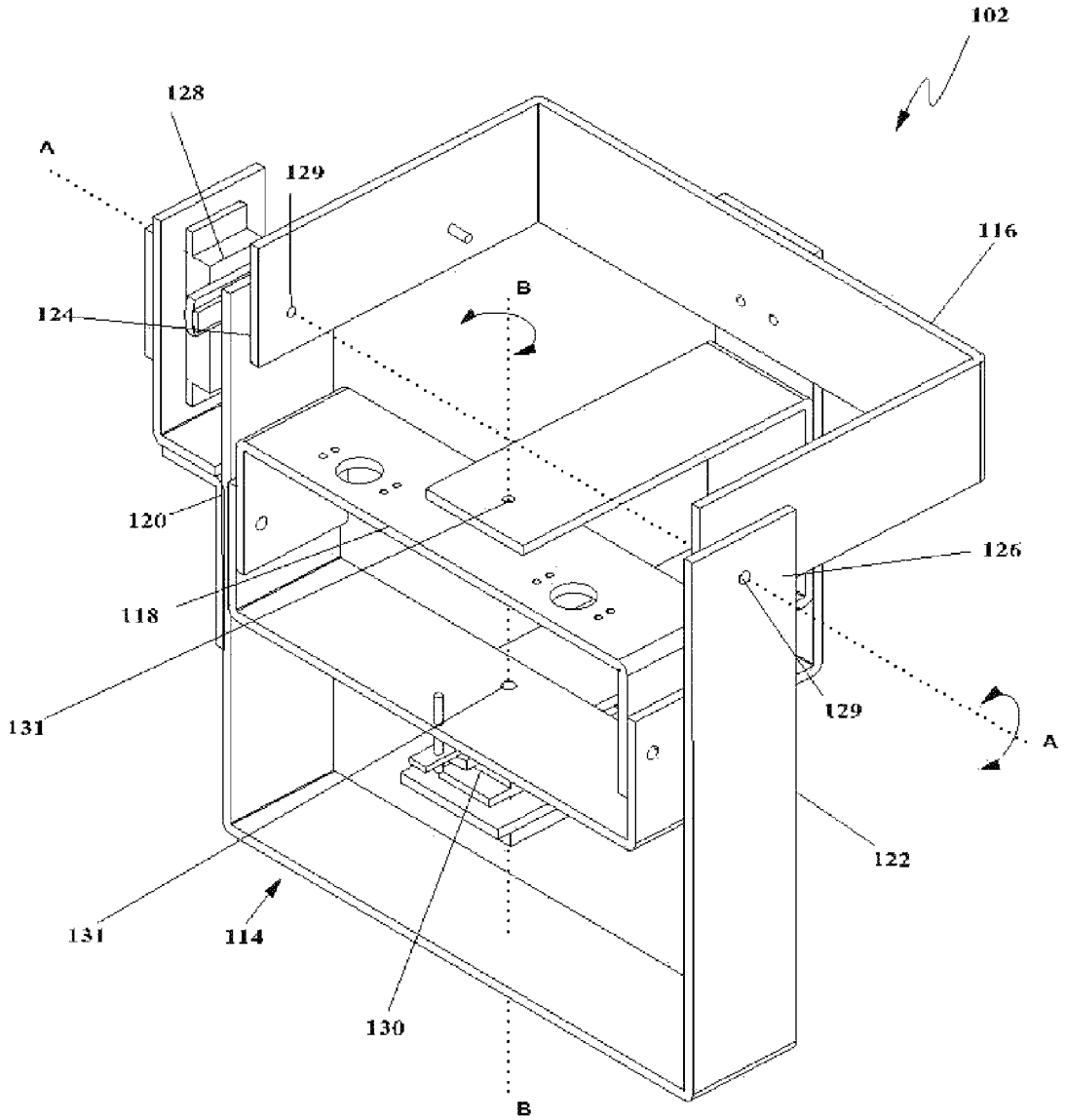
FIG. 3 is a front, side perspective view of the dual pivoting launch assembly of the version shown in FIG. 2A.

FIG. 3 is a perspective view of the dual pivoting launch assembly 102. The dual pivoting launch assembly 102 comprises a fixed frame mount 114, a first pivoting frame 116 that rotates about a fixed first axis A and a second pivoting frame 118 that rotates about a second axis B collectively providing a launch angle and a launch path 106 relative to the fixed frame mount 114. In the version, the first axis A intersects the second axis B at a perpendicular angle intersecting near the launch point 104. In the preferred version, said launch point is fixed and corresponds to approximately the place where the shuttlecock contacts the first and second launch wheels; thus adding stability and consistency. The fixed frame mount 114 comprises a first and second vertically disposed support members 120 and 122 with a first and second upper ends 124 and 126 which the first axis A horizontally passes through.

The first pivoting frame 116 is attached and rotatable about the first axis A by one or more first rivets 129 or other axle means to the fixed frame mount 114. In the illustrated version, the horizontal displacement of the first pivoting frame has a range of motion of approximately +/−60 degrees from the center, default position or 120 degrees total about the axis A. The second pivoting frame 118 is attached by one or more second rivets 131 or other axle means of rotation to the first pivoting frame 116. In the illustrated version, the vertical displacement of the second pivoting frame has a range of motion of approximately +/−60 degrees from the center, default position or 120 degrees total about the axis B.

The second pivoting frame 118 is moved to the right or left about the second axis B by a controlled rotary actuator 130 mounted on the first pivoting frame 116, and the first pivoting frame 116 is moved upwards and downwards about the first axis A by a controlled rotary actuator 128 mounted on the fixed frame mount 114. In the preferred version, the rotary actuators 128 and 130 are a servomotor that allows for precise control of the angular position of each frame. Ideally, the servomotor axels are aligned with the rotating axis. It will be known that other rotary actuators may be utilized such as standard electric motors and motors coupled with gear sets.

The fixed frame mount 114 may be fixedly mounted to a base or stand or anything that would be adequate to support the version in a fixed, operable position. It will also be known that the dual pivoting launch assembly can be configured to rotate in any manner that achieves the desired range of launch paths. For example, in an alternative version, a first pivoting frame is coupled with a fixed frame that is configured to rotate about a fixed vertical axis and a second pivoting frame is coupled with the first frame to rotate about a second horizontal axis, thus achieving the desired launch angle and launch path.

Figure 4:
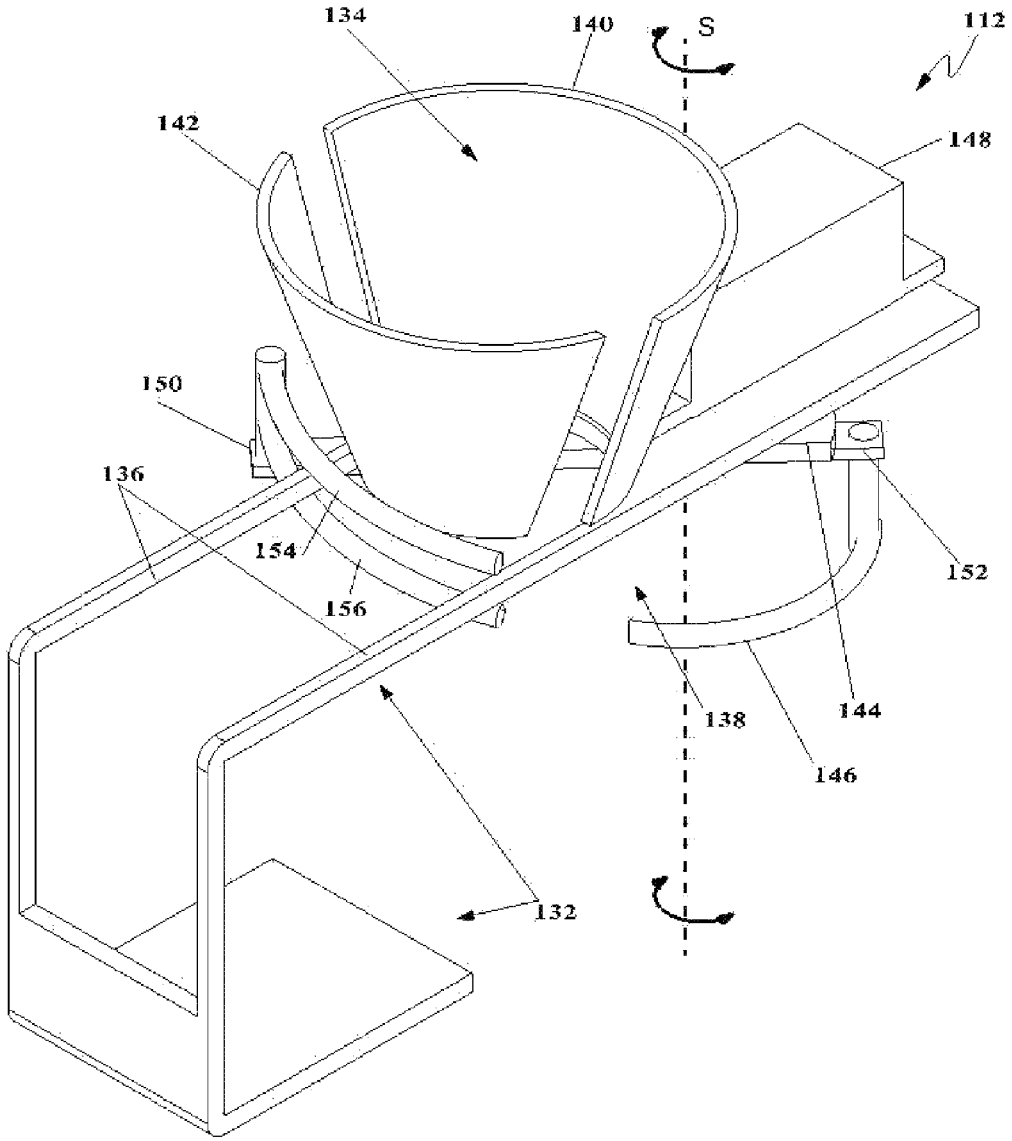
FIG. 4 is a front, side perspective close-up view of the holding and transfer assembly of the version shown in FIG. 2A.
Figure 5A:
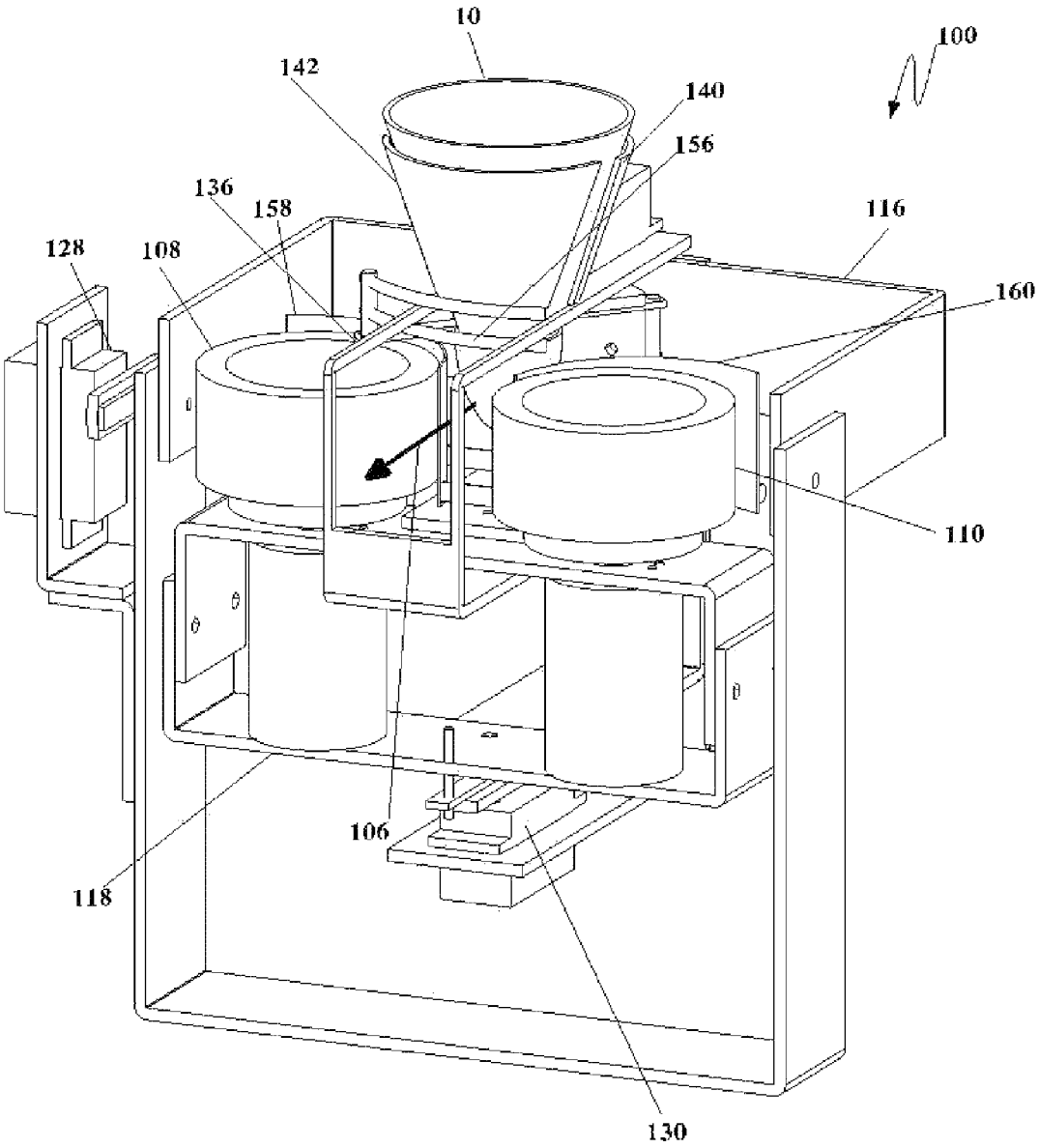
FIG. 5A is a front, side perspective view of the version of FIG. 2A in the default, neutral position with a loaded shuttlecock in holding area of the shuttlecock holding and transfer assembly.
Figure 5B:
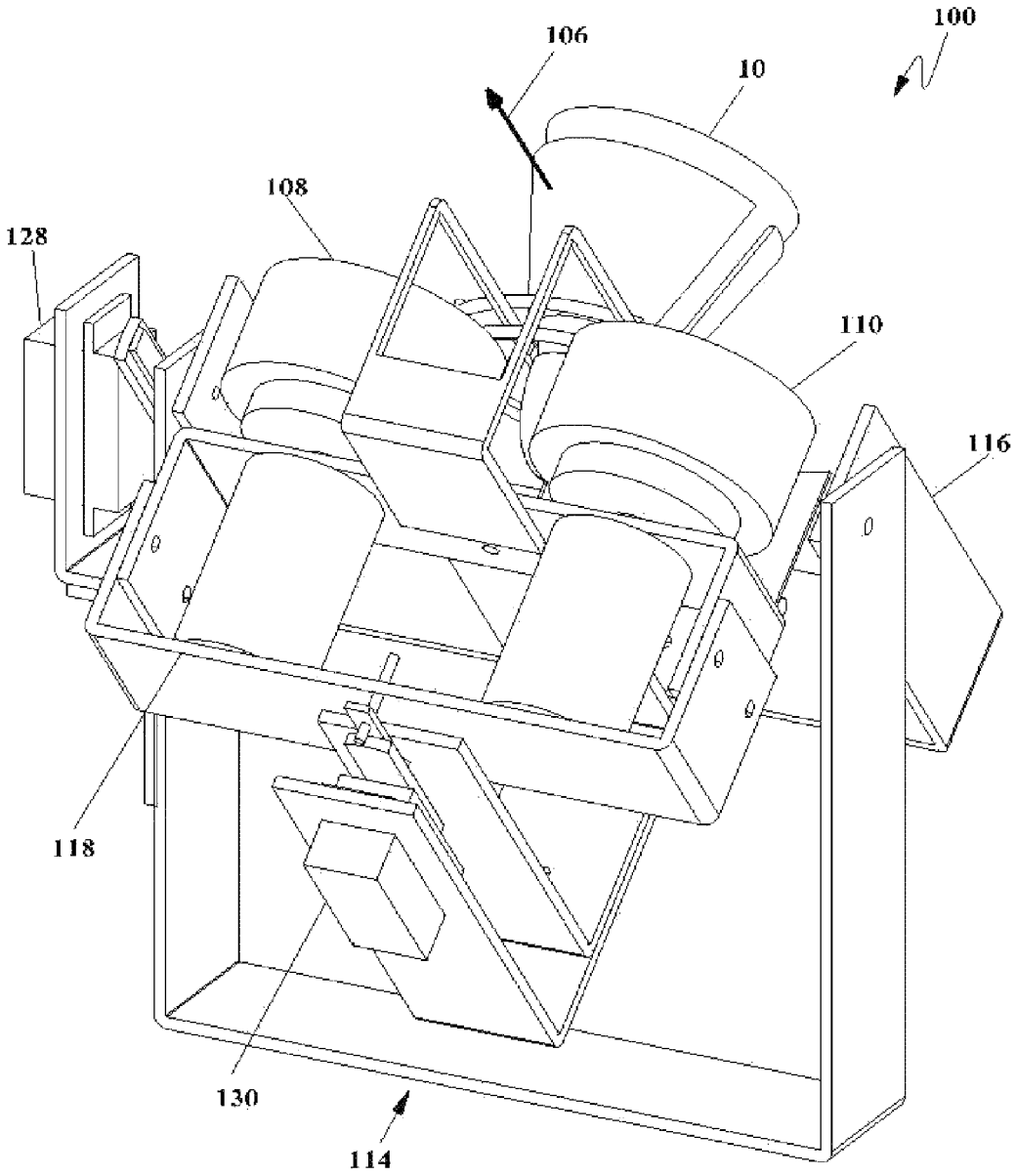
FIG. 5B is an exemplary front, side perspective view of the version of FIG. 2A, wherein the first frame is rotated about the first axis providing an upward launch angle and launch path.
Figure 5C:
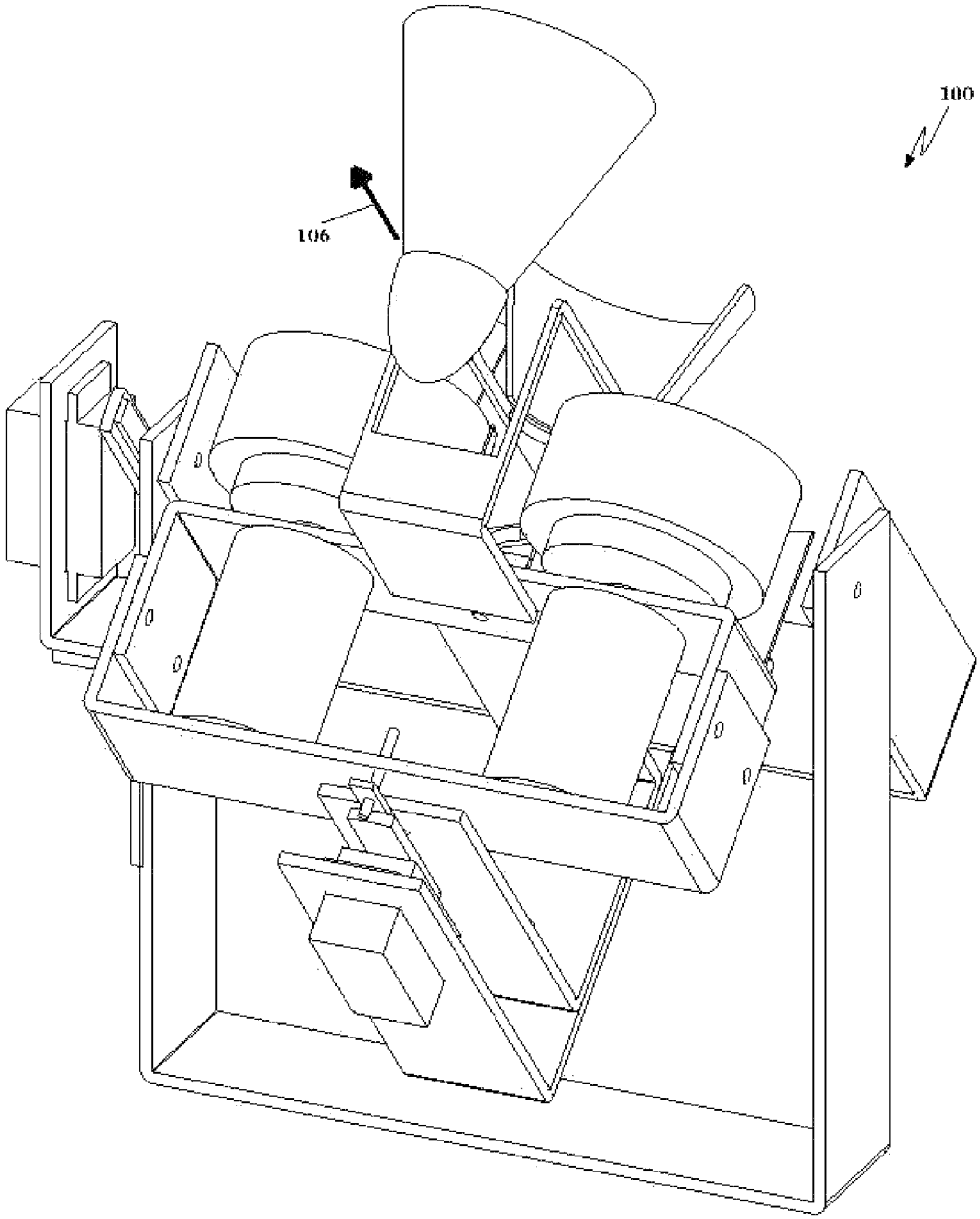
FIG. 5C is an exemplary front, side perspective view of the version of FIG. 2A illustrating the launch path of a shuttlecock of FIG. 5B.
Figure 5D:
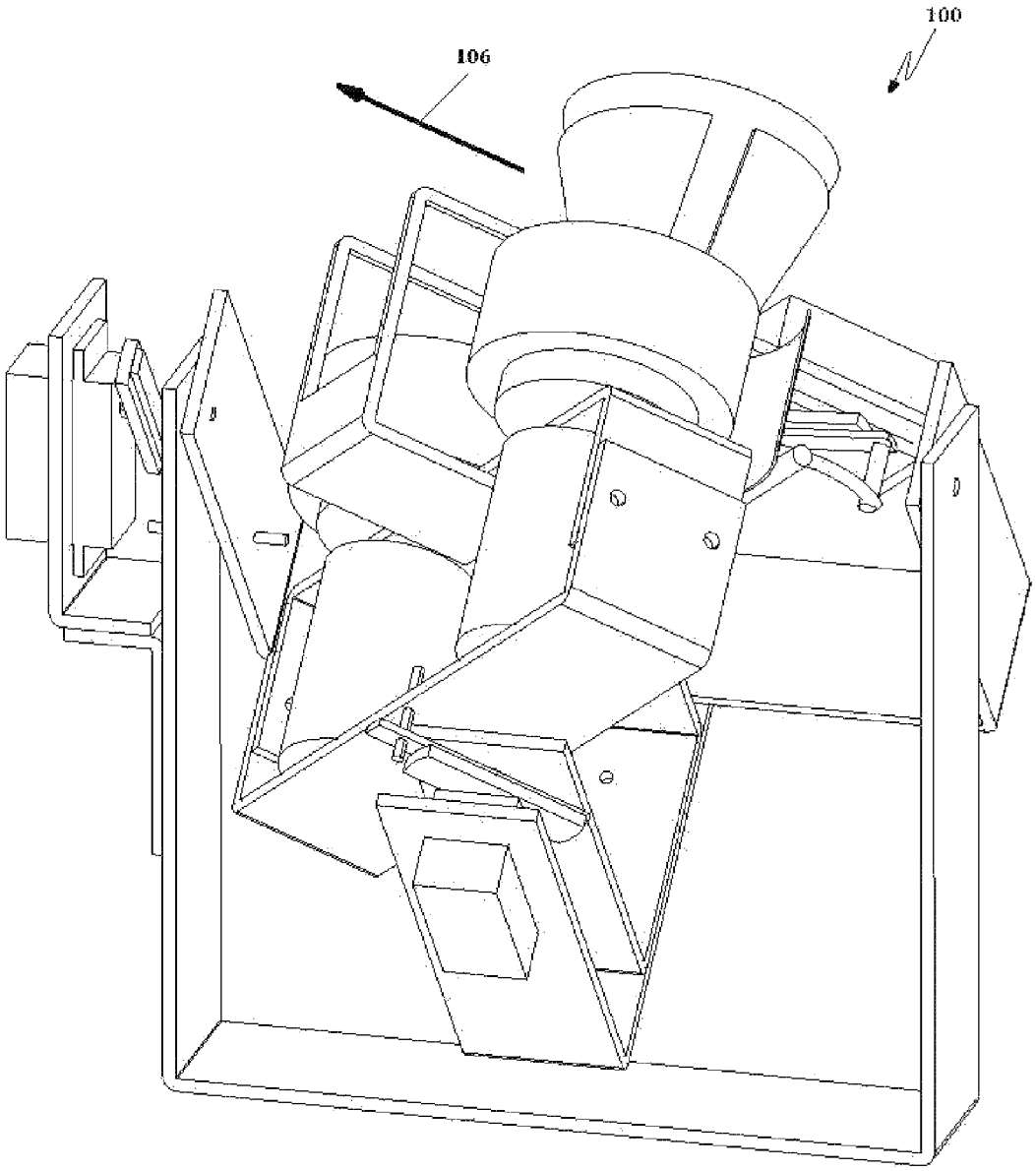
FIG. 5D is an exemplary front, side perspective view of the version of FIG. 2A, wherein the first frame is rotated about the first axis and the second frame is rotated about the second axis providing a launch angle and launch path.
Figure 5E:
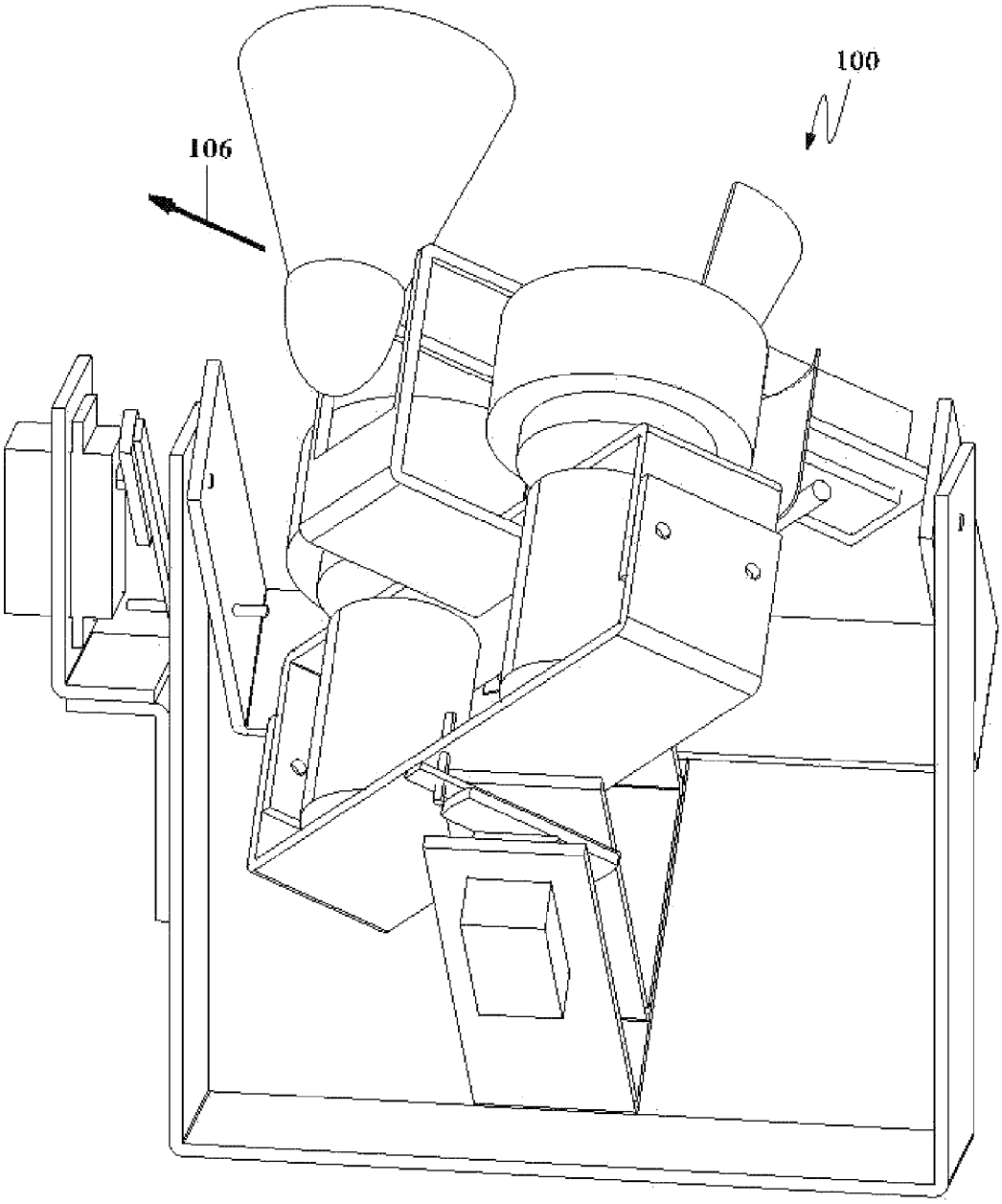
FIG. 5E is an exemplary front, side perspective view of the version of FIG. 2A illustrating a launch path of a shuttlecock of FIG. 5D.
Figure 5F:
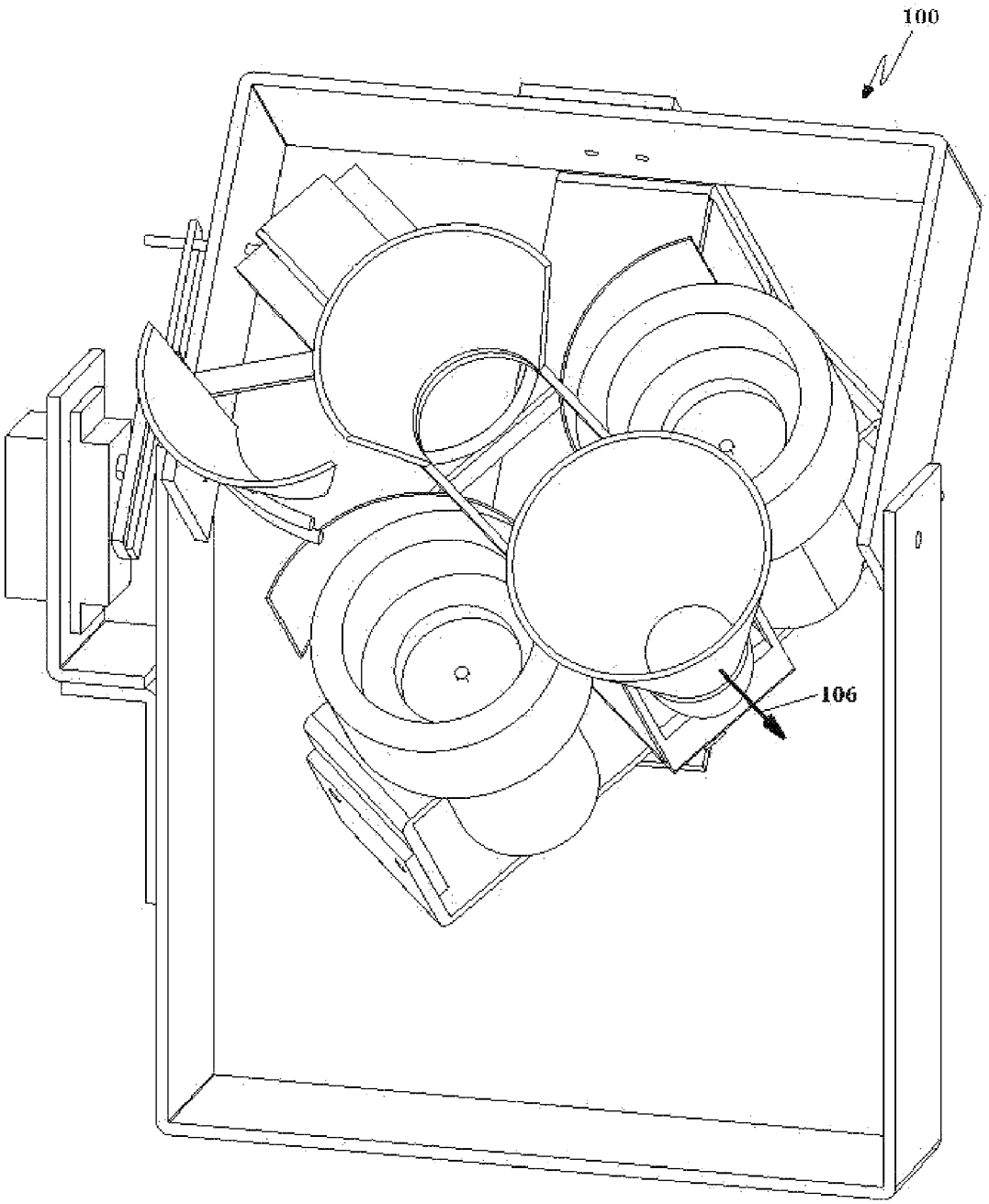
FIG. 5F is an exemplary front, side perspective view of the version of FIG. 2A illustrating a launch path of a shuttlecock.

Referring now to FIG. 2A, FIG. 2B and particularly FIG. 4 and FIG. 5A, the shuttlecock holding and transfer assembly 112 comprises a first supporting frame assembly 132, a pair of horizontally disposed shuttlecock guidance rails 136, a holding area 134, and a shuttlecock transfer mechanism generally depicted as 138. The holding area 134 and the shuttlecock transfer mechanism 138 are supported by the first supporting frame assembly 132. The first supporting frame assembly 132 is centrally attached to and moves with the second pivoting frame 118. The first supporting frame assembly 132 and the holding area 134 suspend the shuttlecock above and behind the first and second launching wheels 108, 110. The pair of horizontally disposed shuttlecock guidance rails 136 are embedded within the first supporting frame assembly 132.

The holding area 134 comprises a semi-cone shaped area adaptable to receive and hold a single shuttlecock 10 in a loaded position. The semi-cone shaped area is formed by a rear fixed portion 140 and a front gate portion 142. The shuttlecock transfer mechanism 138 is a rotating assembly that comprises a central rotating member 144, including the front gate portion 142, and a rear thrust member 146. The central rotating member 144 rotates about a vertical axis S actuated by a first rotary actuator 148 having a forward end 150 and a rearward end 152. The front gate portion 142 is affixed near the forward end 150 of the central rotating member 144 and thus forms to enclose the holding area 134 while in a closed position. The rear thrust member 146 is generally horizontally affixed near the rearward end 152 of the central rotating member 144 and is aligned substantially in the same horizontal plane which passes through the shuttlecock base 14 of the shuttlecock 10 while in the loaded position within the holding area 134. The front gate portion 142 is configured to move in a path of motion that has at least an open position and a closed position. The rear thrust member 146 is configured to provide the forward motion to the shuttlecock 10 simultaneous the front gate portion 142 moves into the open position, thereby transferring the shuttlecock from the holding area 134 to the launch point 104 which is further described below. The circular motion of the transfer mechanism is driven by a first rotary actuator 148 or digitally controlled electric motor.

The shuttlecock transfer mechanism 138 further includes a front gate support member 154 and a lower shuttlecock support member 156. The front gate support member 154 connects the front gate portion 142 to the forward end 150 of the central rotating member 144. The lower shuttlecock support member 156 is utilized to further support the shuttlecock base 14 of a shuttlecock 10 while the shuttlecock 10 is in the loaded position further described below.

Referring back to FIGS. 2A and 2B, the first and second launch wheels 108 and 110 are operatively positioned adjacent to the shuttlecock holding and transfer assembly 112 for receipt of a shuttlecock therefrom. The first and second launching wheels 108, 110 are affixed in an operative, coplanar manner to the second pivoting frame 118. The first and second launching wheels 108, 110 operate independently and can be configured to counter rotate, rotate one at a time, or rotate in the same direction, all at the same or variable speeds depending on the type of desired shot. Generally, the launch wheels counter rotate thus providing a forward thrust to the shuttlecock 10 along the launch path 106.

More particularly, the first and second launching wheels 108, 110 are spaced apart by a distance slightly less than the diameter of the shuttlecock base 14 for a tight grip during launch. The version further comprises first and second fenders 158 and 160 that are positioned adjacent to the rear of the first and second launching wheels 108, 110 which assist in guiding the shuttlecocks to the launch point. This provides a consistent and accurate contact with the first and second launching wheels 108, 110. The first and second launching wheels 108 and 110 are independently driven by first and second rotatory actuators 162 and 164. In the preferred version, the rotary actuators can be variable speed brushless motors that are digitally controlled.

In the version, all moving mechanical parts are electronically controlled and orchestrated by a programmable control system 30 utilizing certain launch parameters and other mechanical movements. The launch parameters comprise of the launch path created by the angular movement of the first and second pivoting frames 116, 118 about the first axis A and the second axis B; the launching speed or shot type of the shuttlecock is determined by the independent velocities of the first and second launching wheels 108, 110; and the frequency of the launches determined by the activation timing of the operation of the shuttlecock holding and transfer assembly 112. The launching parameters can vary according to the impact point locations, shot type, stroke type, and training level of the player. The programmable control system 30 orchestrates the launch sequences by sending and receiving signals from and to all of the components and mechanical parts by executing a pre-programmed series of shots in a specific sequence or a random sequence; or under the direct input or control by the operator via a control interface such as a remote control or other attached or tethered display.

The basic method of a version of the invention is as follows which comprises: providing a dual pivoting launch assembly 102 providing a plurality of launch angles; providing a first and second launching wheels 108, 110; providing a holding and transfer assembly 112 comprising: a holding area 134 for receiving and holding a single shuttlecock 10, and a shuttlecock transfer mechanism 138 for transferring the shuttlecock from the holding area 134 to the first and second launching wheels 108, 110; loading a single shuttlecock 10 within the holding area 134 of the shuttlecock holding and transfer assembly 112; moving the dual pivoting launch assembly to a desired launch angle and launch path 106; shuttlecock transfer mechanism 138 transferring the single shuttlecock 10 to the first and second launching wheels 108, 110; and first and second launching wheels 108, 110 launching the single shuttlecock 10 along a launch path 106.

Referring to FIG. 5A-FIG. 6H, the operation of the version 100 will be explained in more detail in three phases. Namely, a shuttlecock receiving phase, an aiming phase, and a transfer and launch phase.

In the shuttlecock receiving phase, the launcher is in the default, neutral position as depicted by FIG. 5A. While in the default position, the launch angle and launch path 106 provided by the dual pivoting launch assembly 102 is in a level, straight forward position and the shuttlecock holding and transfer assembly 112 is ready to receive a shuttlecock 10. Thus, a shuttlecock can be placed into the holding area 134 via manually by a person or by a mechanical device or in any manner that is known in the art. The version is now in the loaded position. As depicted in FIG. 5A, the shuttlecock 10 is in the loaded position which is securely seated and positioned within the holding area 134 between the rear fixed portion 140 and the front gate portion 142. While in this position, the shuttlecock 10 gently rests on the horizontally disposed shuttlecock guidance rails 136 at a point just above where the feathers meet the shuttlecock base 14 of the shuttlecock 10. Further, the lower shuttlecock support member 156 is utilized to add support to the shuttlecock base 14 of the shuttlecock 10 and prevents the shuttlecock base 14 from prematurely sliding forward. The applied combination of the rear fixed portion 140, the front gate portion 142, the pair of horizontally disposed shuttlecock guidance rails 136 and the lower shuttlecock support member 156 allows the shuttlecock 10 to fit securely and snuggly, so that it will remain in the same location relative to the launching wheels 108 and 110 while the shuttlecock launcher is in operation or while moving into a launch position for a specified launch angle and launch path 106 and trajectory as described below.

According to the aiming phase and now referring to FIGS. 5A-5F, it is illustrated how the dual pivoting launch assembly 102 is utilized to launch the shuttlecock 10 within a wide range of launch angles, trajectories and velocities to simulate a badminton shot. The control system 30 controls the operation of both the dual pivoting launch assembly 102 and first and second launching wheel 108, 110 velocity to impart a velocity, trajectory, and spin to a shuttlecock for launching the shuttlecock from the apparatus toward an intended location or for a desired shot type.

The launch angle is adjustable and controlled by the control system 30 by rotating the first and second pivoting frames by rotating the corresponding rotary actuators 128, 130 based on the predetermined or random launch parameters stored by the programmable control system 30 for a desired badminton launch path 106 and trajectory. As illustrated in FIGS. 5B-5F, the dual pivoting framework will simultaneously or in sequence position itself according to the instructed launch angle and launch path 106 via the controlled vertical rotation of the first pivoting frame 116 and the horizontal rotation of the second pivoting frame 118.

The velocities of the first and second launching wheels 108 and 110 are achieved independently according to shot speed and shot type via the digitally controlled first and second rotary actuators 82 and 84 which are orchestrated by the programmable control system 30. Once the launch path 106 and desired wheel velocities have been achieved, the shuttlecock launcher version 100 is ready for launch.

The final phase of the launch is the controlled, consistent transfer of the shuttlecock to the launch point 104 contacting the first and second launching wheels 108, 110, thereby launching in the desired direction and at the desired speed in order to provide a desired badminton shot.

Figure 6A:
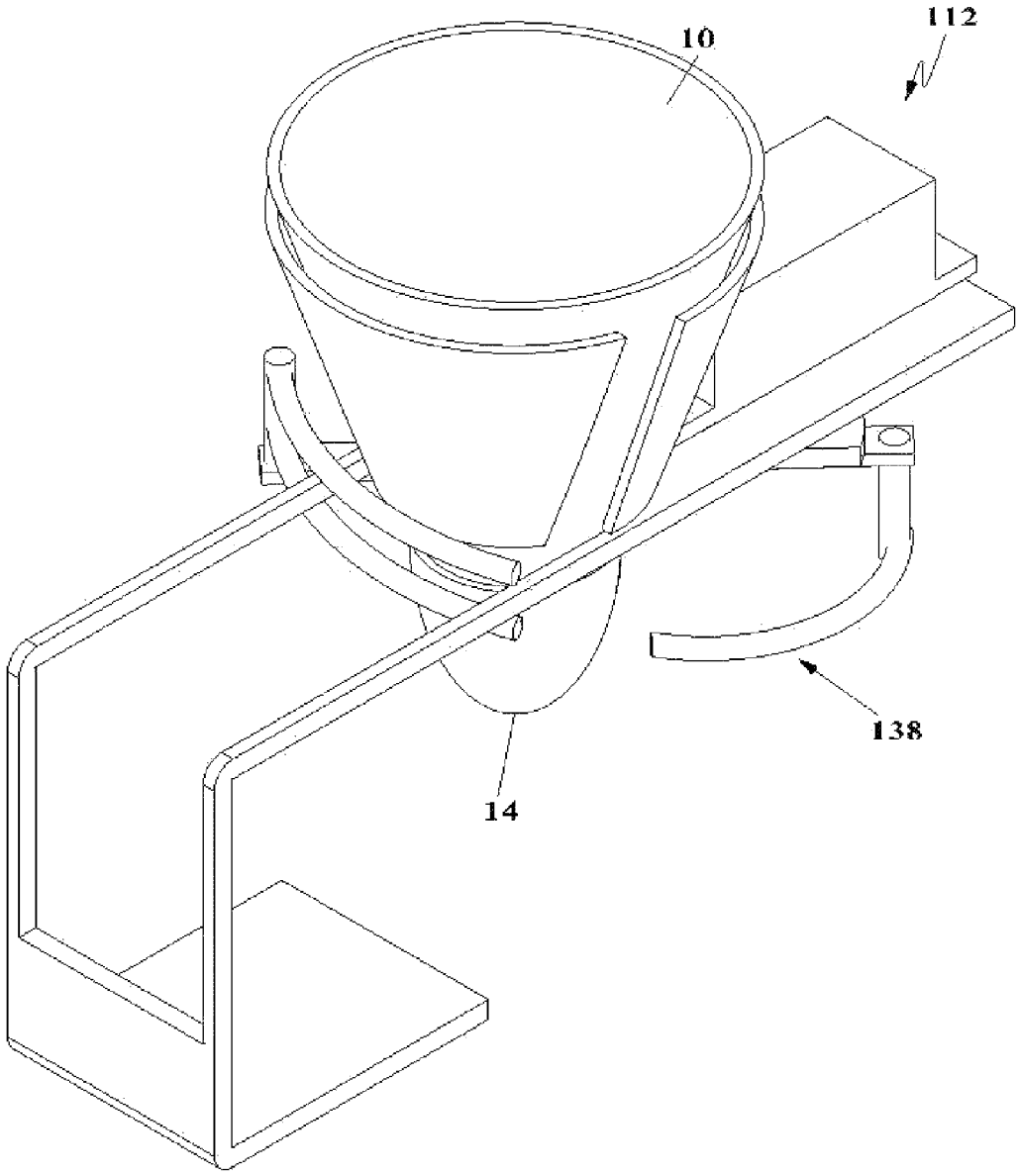
FIG. 6A is a front, side perspective close-up view of the holding and transfer assembly of the version shown in FIG. 2A with a loaded shuttlecock in the holding area.
Figure 6B:
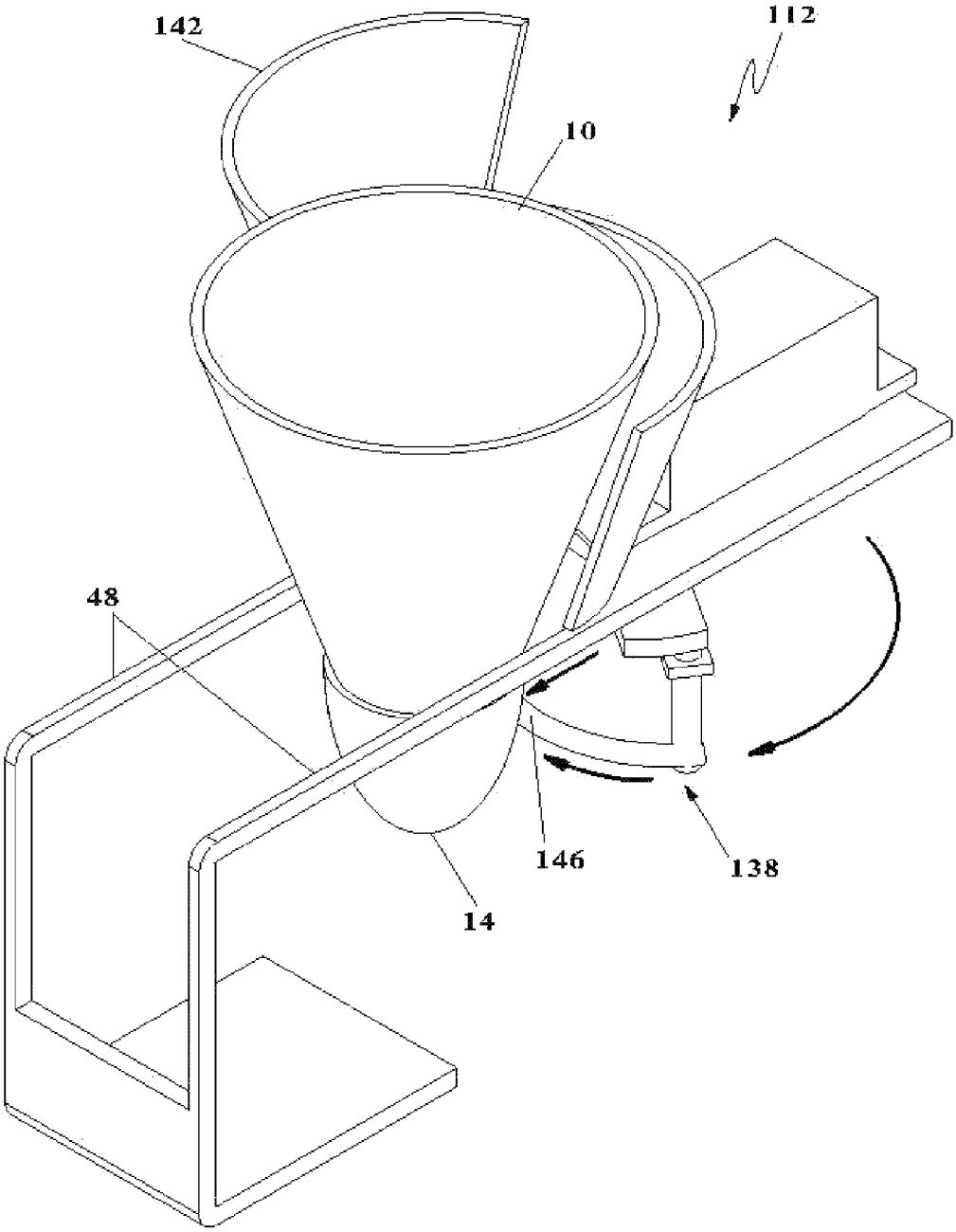
FIG. 6B is a front, side perspective close-up view of the holding and transfer assembly of the version shown in FIG. 2A with the gate moving to the open position and the thrust transfer mechanism providing a forward thrust to the shuttlecock.
Figure 6C:
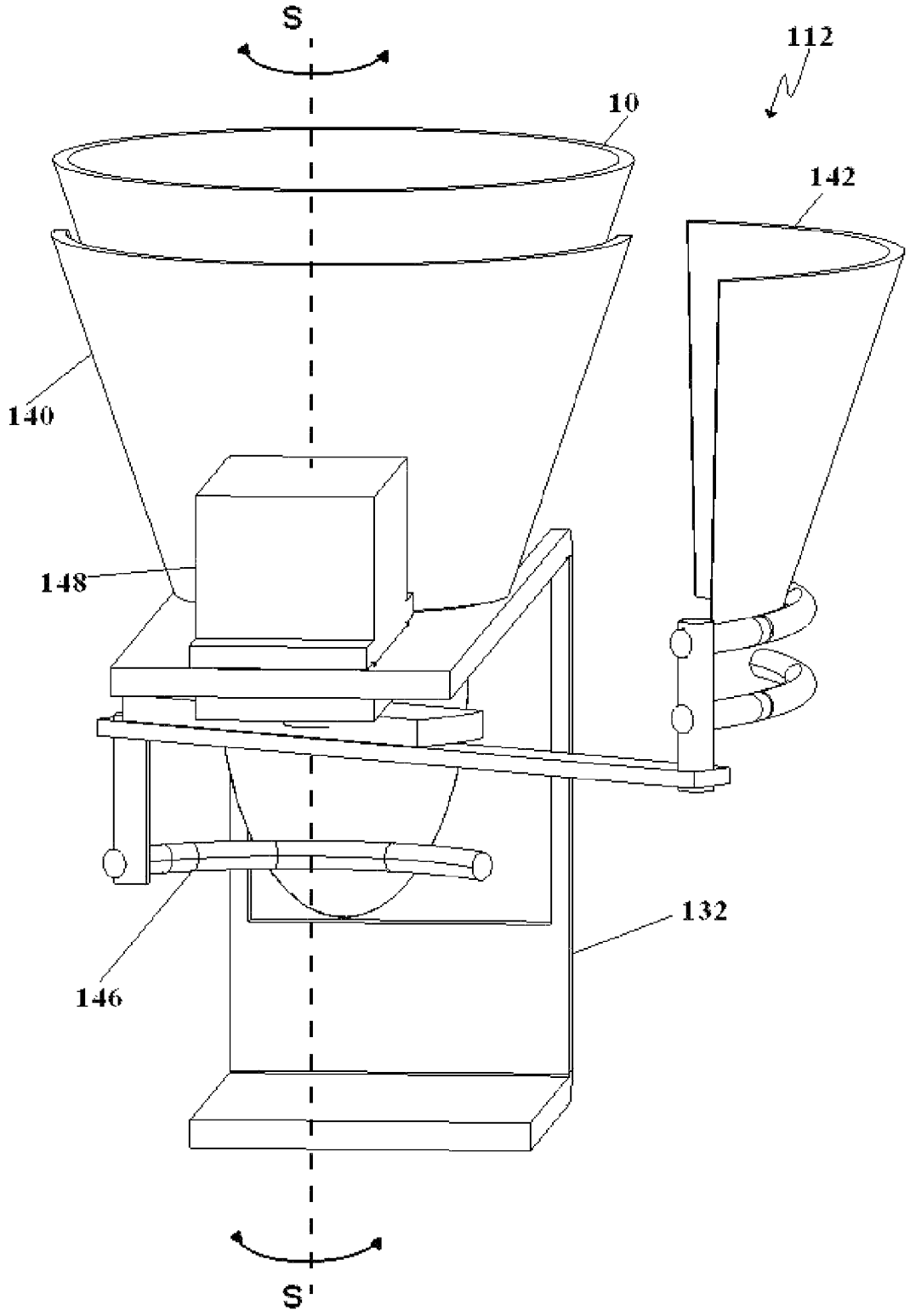
FIG. 6C is an illustrative rear, side perspective close-up view of the holding and transfer assembly of the version shown in FIG. 2A with the gate moving to the open position and the thrust transfer mechanism providing a forward thrust to the shuttlecock.
Figure 6D:
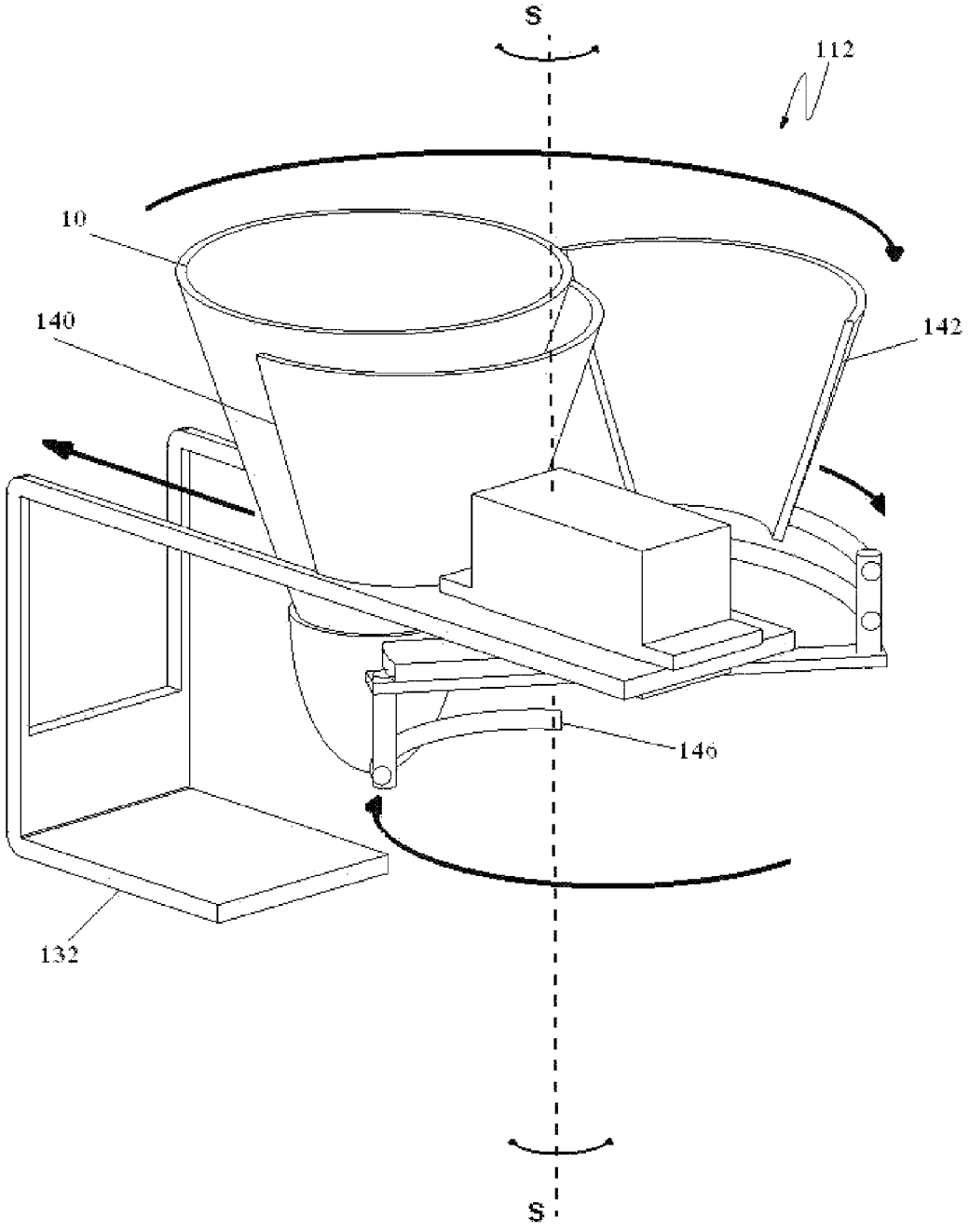
FIG. 6D is an illustrative rear, side perspective close-up view of the holding and transfer assembly of the version shown in FIG. 2A with the gate moving to the open position and the thrust transfer mechanism providing a forward thrust to the shuttlecock.
Figure 6E:
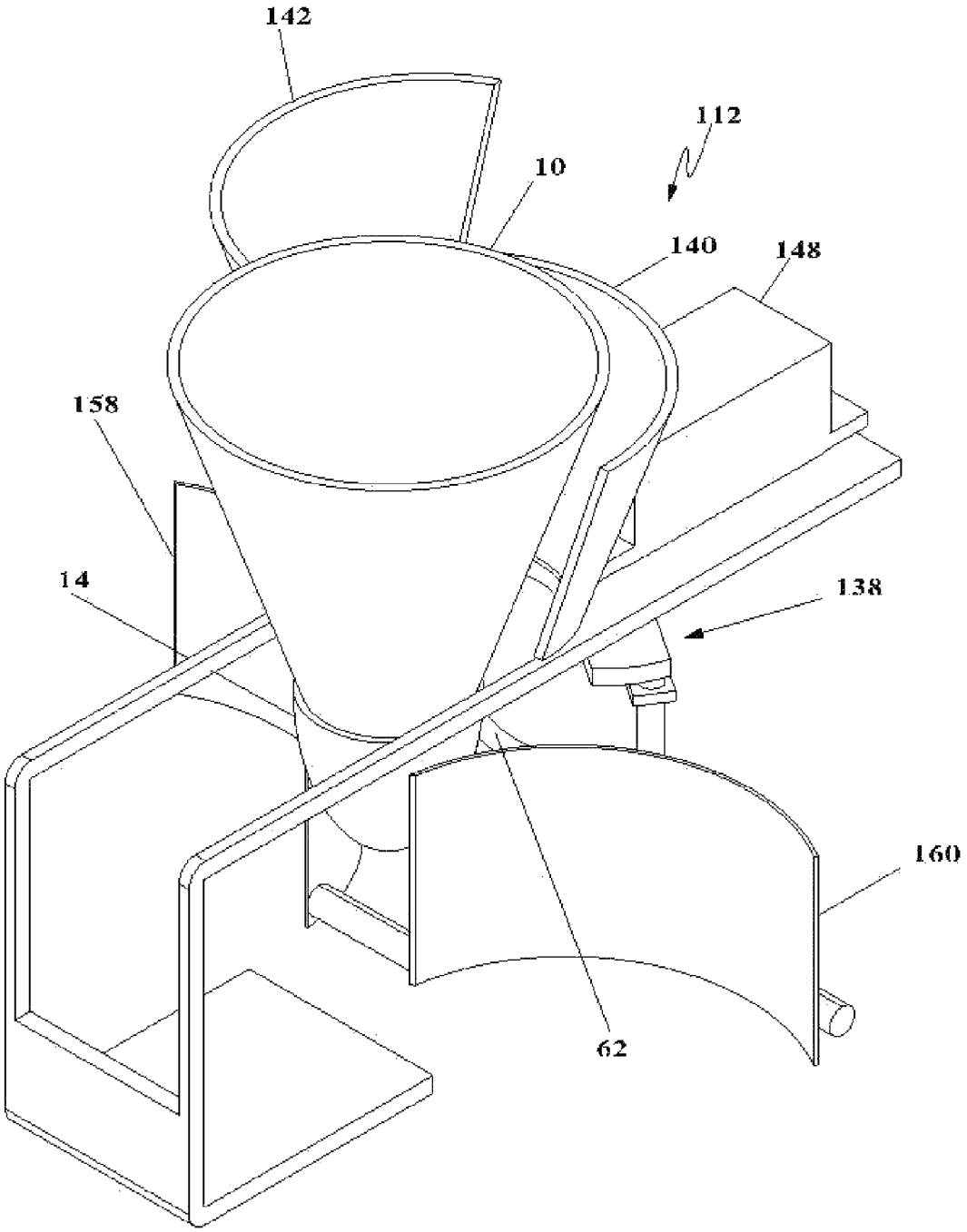
FIG. 6E is an illustrative front, side perspective close-up view of the holding and transfer assembly including the first and second fenders of the version shown in FIG. 2A illustrating the transfer of the shuttlecock to the launch point.
Figure 6F:
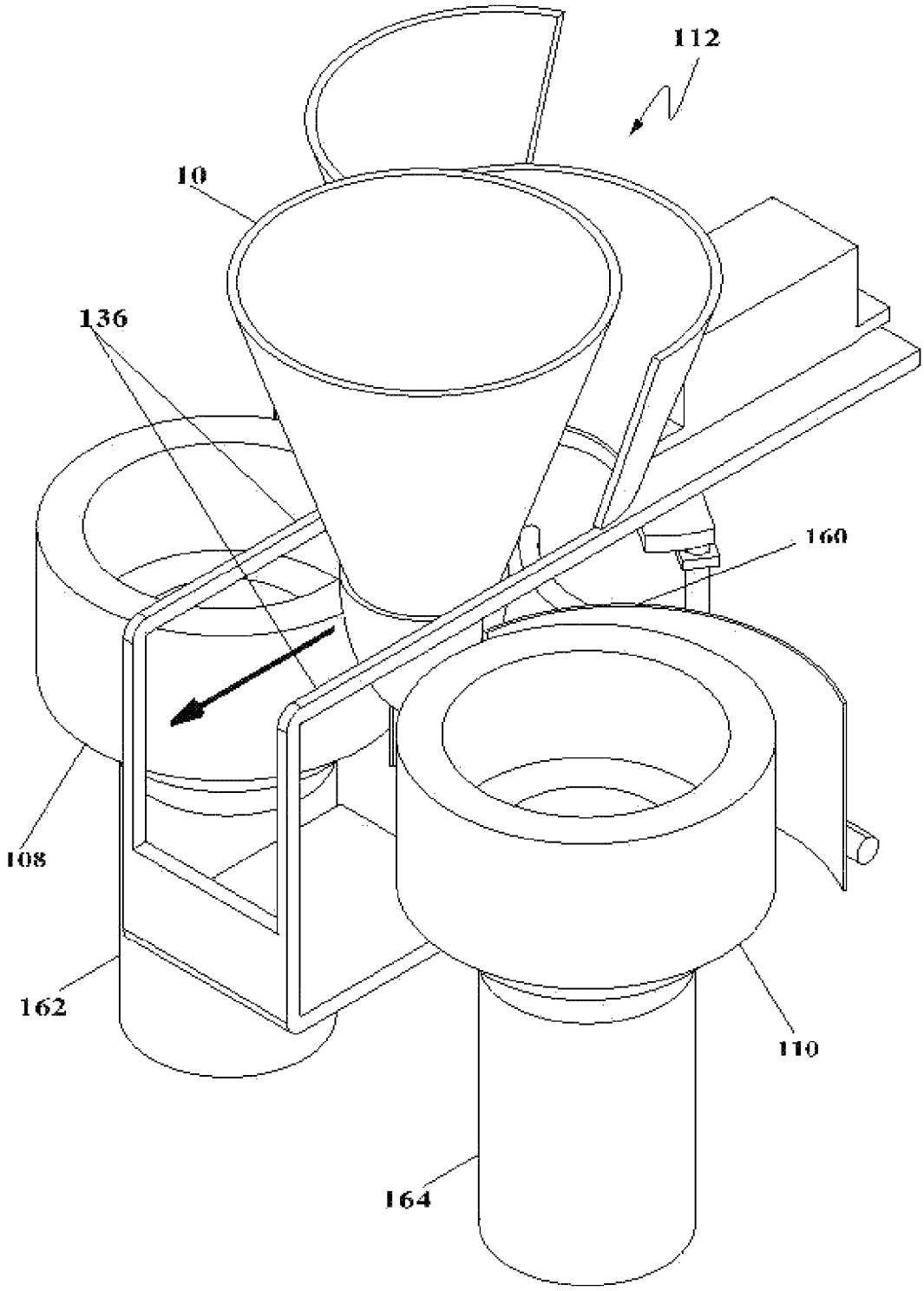
FIG. 6F is an illustrative front, side perspective close-up view of the holding and transfer assembly including the first and second fenders of the version shown in FIG. 2 illustrating the transfer of the shuttlecock to the launch point.
Figure 6G:
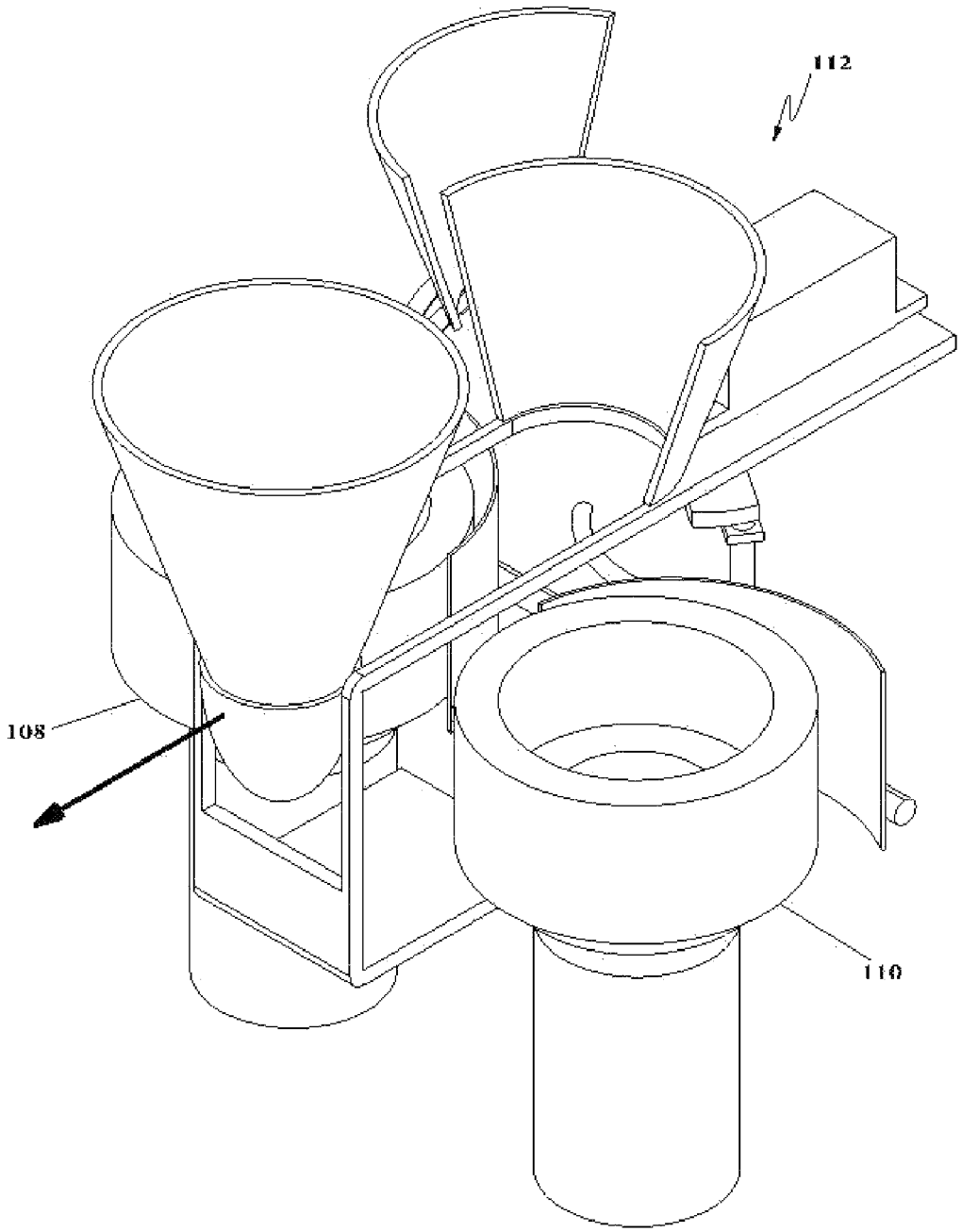
FIG. 6G is an illustrative front, side perspective close-up view of the holding and transfer assembly including the first and second fenders and first and second launch wheels of the version shown in FIG. 2A illustrating the launching of the shuttlecock along the launch path.

Referring now to FIG. 6A-FIG. 6G, the shuttlecock transfer to the first and second launching wheels 108, 110 will be explained. FIG. 6A is a more detailed close up view of the shuttlecock 10 in the loaded position awaiting queue to be transferred to the first and second launching wheels 108, 110. While in the loaded position, the front gate portion 142 is in the closed position and the rear thrust member 146 is not engaging the shuttlecock 10. As illustrated in FIG. 6B, when the shuttlecock launcher is ready to launch, the programmable control system 30 instructs the first rotary actuator 148 to rotate the shuttlecock transfer mechanism, generally depicted by 138, about the vertical axis S in one circular motion simultaneously moving the front gate portion 142 to the open position and moves the rear thrust member 146 to the shuttlecock providing a forward thrust, thereby transferring the shuttlecock forward from the holding area 134 along the pair of horizontally disposed shuttlecock guidance rails 136 between the first and second fenders 158, 160 and finally to the launch point 104. As depicted in FIG. 6F, when the shuttlecock 10 is forwarded to the launch point 104, the shuttlecock base 14 makes contact with the rotating first and second launching wheels 108, 110 in an accurate and controllable manner.

More particularly, as depicted by FIG. 6E, during the application of the forward force applied by the rear thrust member 146, first and second fenders 158 and 160 are positioned to guide the shuttlecock base 14 and shuttlecock 10 to the precise location of the launch point 104, contacting the one or more launching wheels 108, 110 so that accuracy and shot consistency is achieved at any launch angle. As depicted by 6G, upon contact of the first and second launching wheels 108 and 110, the shuttlecock 10 is launched uniformly in the desired launch path and trajectory as described above. Examples of various launch angles, launch paths, and trajectories can be seen in FIGS. 5C, 5E and 5F.

Figure 7:
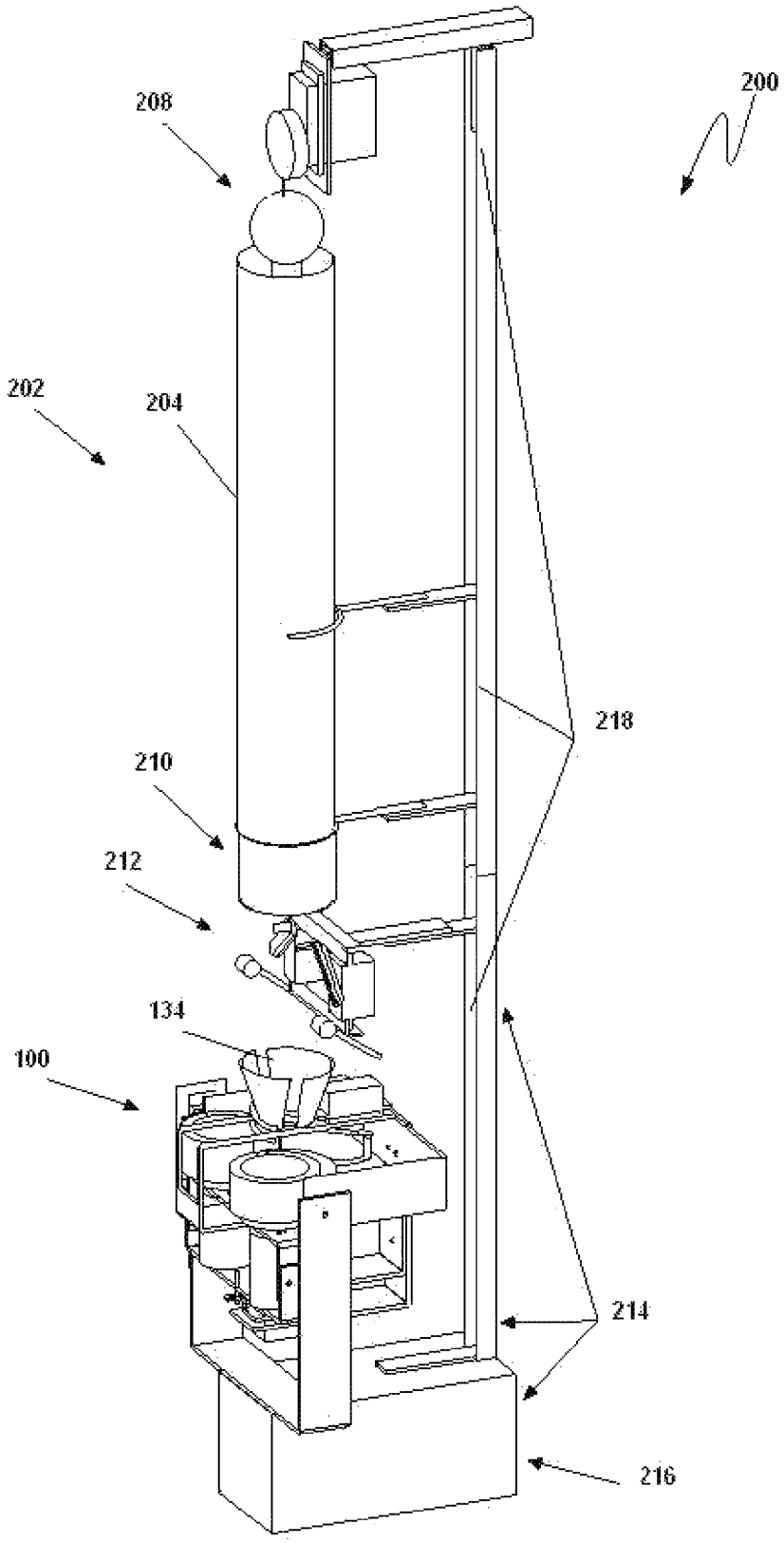
FIG. 7 is a perspective view of a second version of the shuttlecock launching apparatus which comprises a shuttlecock distribution system.

A second version 200 of the shuttlecock launcher is depicted in FIG. 7 which comprises a shuttlecock distribution system generally depicted as 202. The shuttlecock distribution system 202 comprises a shuttlecock storage container 204 capable of housing a stack of one or more shuttlecocks 206, an apparatus for applying a controlled force 208 upon the stack of one or more shuttlecocks 206 within the shuttlecock storage container 204, a shuttlecock filter 210, and a vertical shuttlecock transfer assembly 212. The shuttlecock distribution system 202 can be combined with the previously described version 100 in order to provide a version that not only launches a shuttlecock at various trajectories, velocities, and shot types, but also comprises the ability to receive a stack of one or more shuttlecocks 206, filter a single shuttlecock from the stack of the one or more shuttlecocks, and effectively deliver the single shuttlecock to the holding area 134 ready for launch. The shuttlecock distribution 202 has the ability to operate simultaneous the shuttlecock launching apparatus 100 in order to reduce time between shuttlecock launches and facilitating frequent shots. Moreover, the shuttlecock distribution system 202 with the bi-level filter can hold a separated shuttlecock 10 until the shuttlecock launching apparatus has carried out a launch. It will be known that the shuttlecock distribution system 202 can be combined with other shuttlecock launchers to effectively separate a single shuttlecock from a stack of one or more shuttlecocks.

Figure 8:
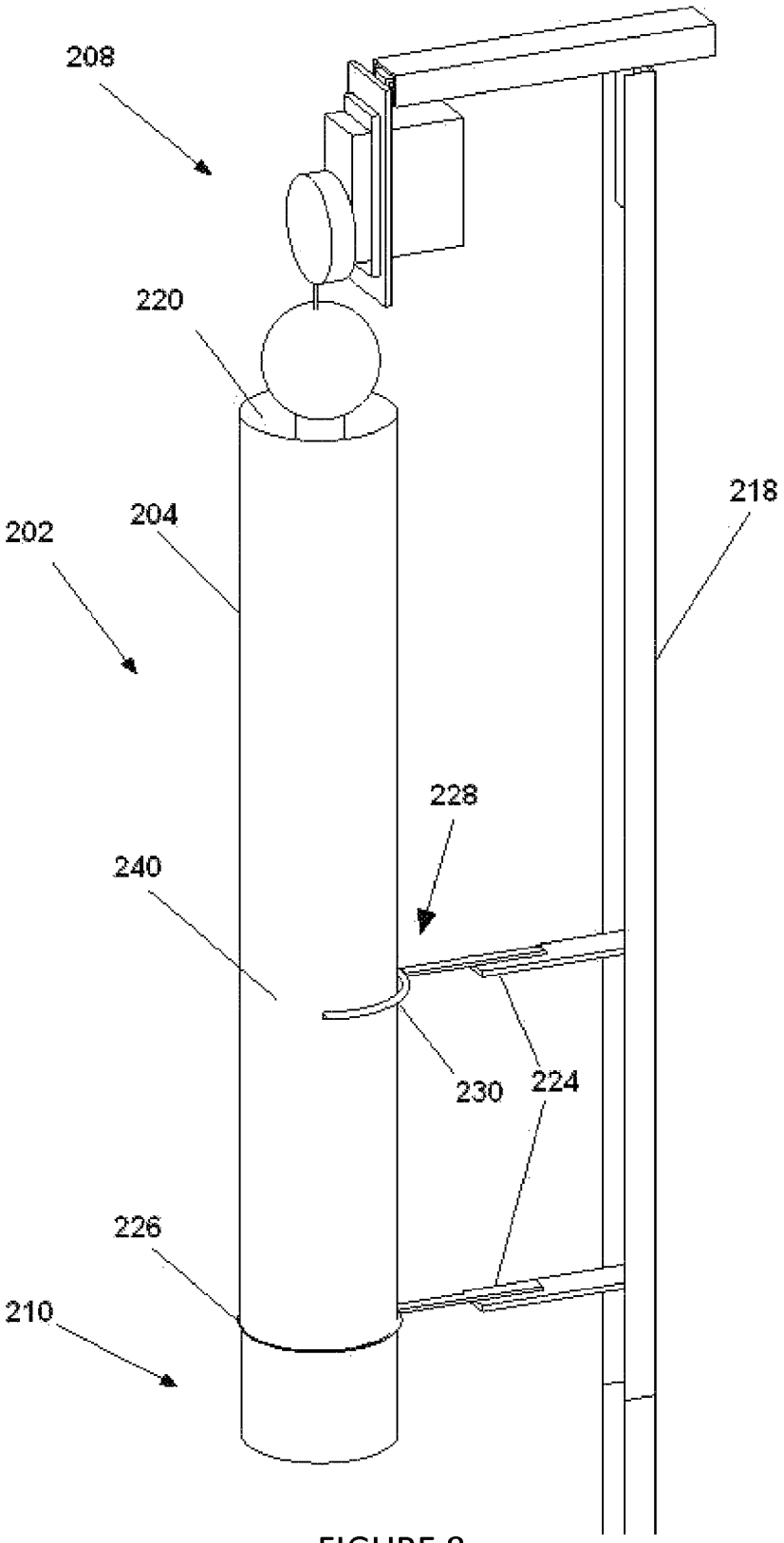
FIG. 8 is a perspective view of the shuttlecock distribution system comprising a shuttlecock storage container, filter, and tube holding assembly of the version shown in FIG. 7.

As depicted in FIG. 7 and FIG. 8, the version 200 comprises a second supporting frame assembly as generally depicted by 214. The second supporting frame assembly 214 comprises a base 216 and a vertical support member 218. The vertical support member 218 is fixedly attached to the base 216 in a vertical position to form a support for the apparatus for applying a force 208, shuttlecock storage container 204, shuttlecock filter 210, and the vertical shuttlecock transfer assembly 212 of the version 200.

Figure 9:
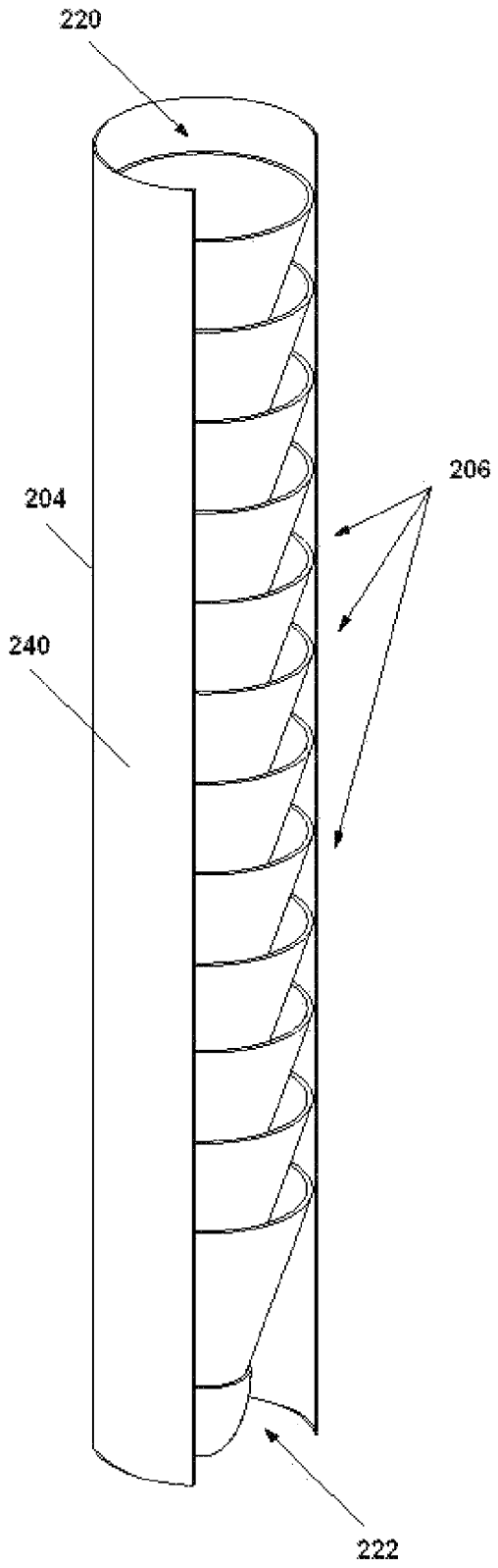
FIG. 9 is a perspective cut-away view of the shuttlecock storage container containing one or more stacked shuttlecocks.

Referring to FIG. 8 and FIG. 9, it is preferred the shuttlecock storage container 204 is a tubular shape with a top opening 220 and a bottom opening 222 at each end which is vertically oriented. A stack of one or more shuttlecocks 206 are placed in a nested position as is known in the art. The shuttlecock storage container 204 can be an industry standard shuttlecock container as sold in stores or a tubular design that is similar in size and configuration.

Figure 10:
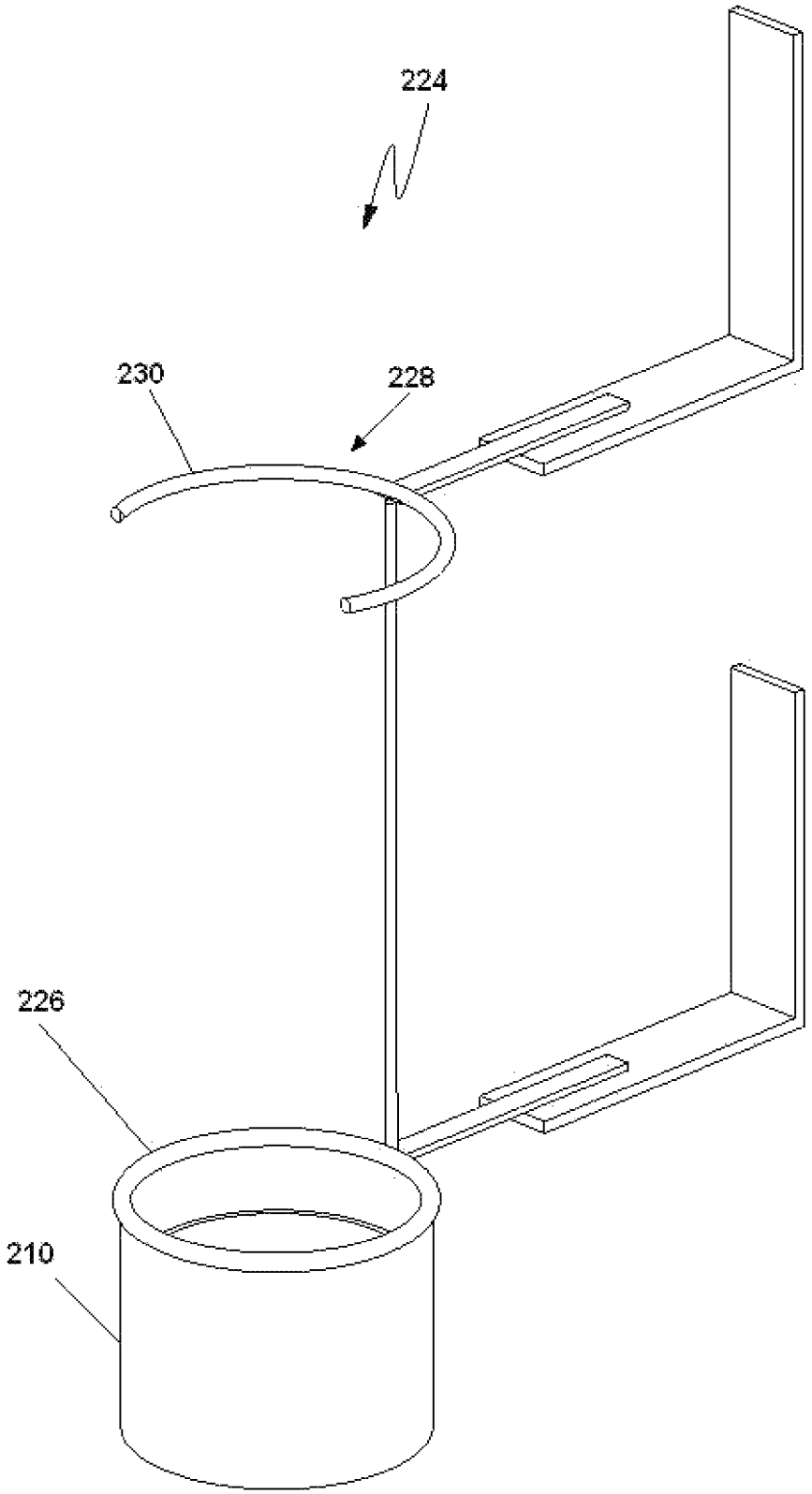
FIG. 10 is an up-close perspective view of the tube holding assembly of the version shown in FIG. 7.

The shuttlecock storage container holding assembly 224 as depicted in FIG. 8 and FIG. 10 comprises a bottom tube receiver and support 226 and an upper tube support brace 228. The bottom tube receiver and support 226 is a rigid circular ring horizontally attached to the vertical support member 218. The bottom tube receiver and support 226 is configured to receive and securely seat the shuttlecock storage container 204 in a vertical position as depicted by FIG. 8. As further support, the upper tube support brace 228 is a pair of rigid semi-circular arms 230 that are horizontally attached to the vertical support member 218. Thus, the shuttlecock storage container holding assembly 224 is configured to enable a user to easily and effortlessly mount and remove the shuttlecock storage container 204 in order to replenish the shuttlecocks. In an alternative version, the shuttlecock storage container holding assembly could be configured to automatically replenish shuttlecocks by having an array of tubes that are automatically interchanged or rotated into the engaged position. Thus, maximizing the duration of shots and minimizing interruption.

Figure 11:
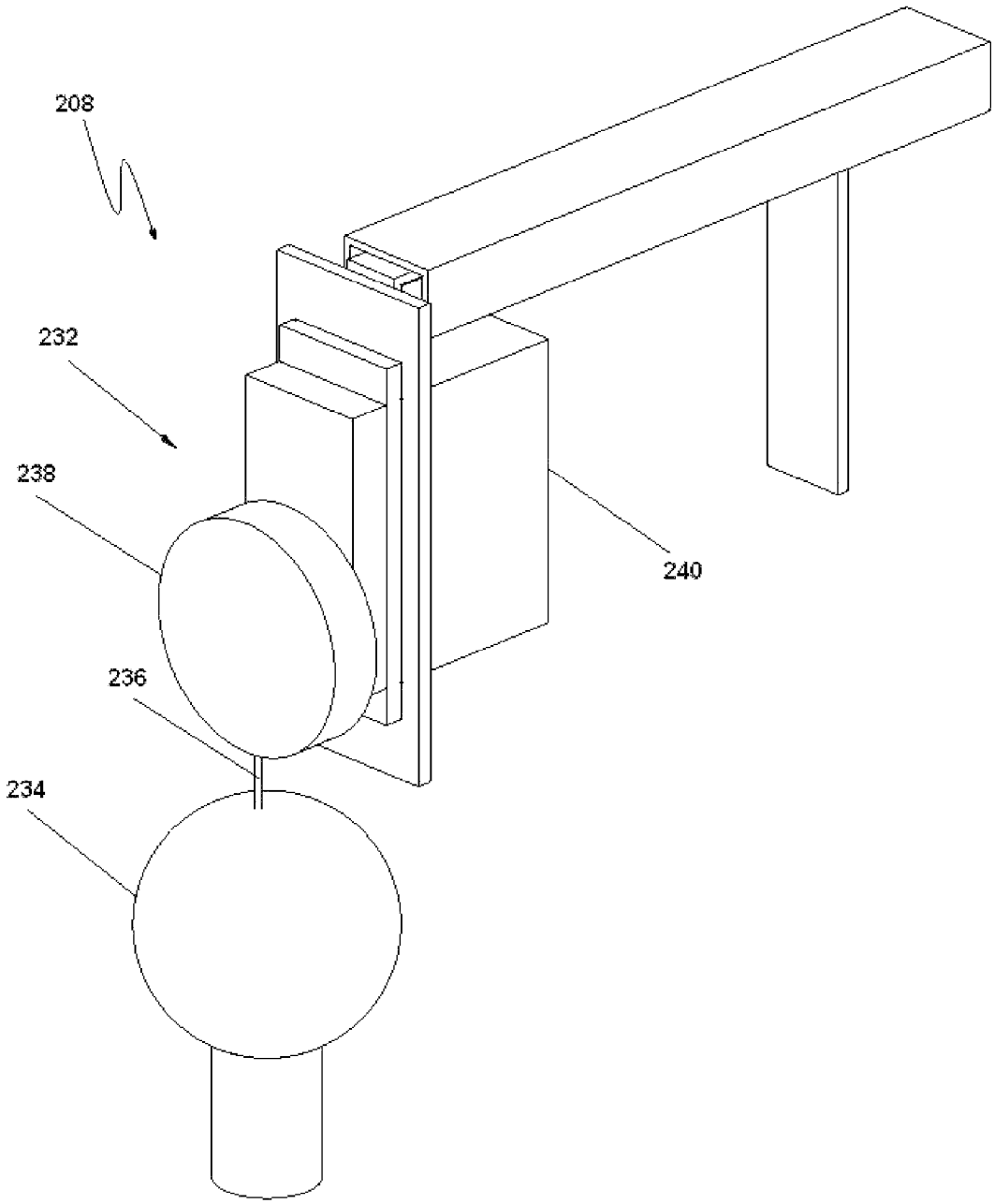
FIG. 11 is an up-close perspective view of the apparatus for applying a controlled force of the version shown in FIG. 7.
Figure 12:
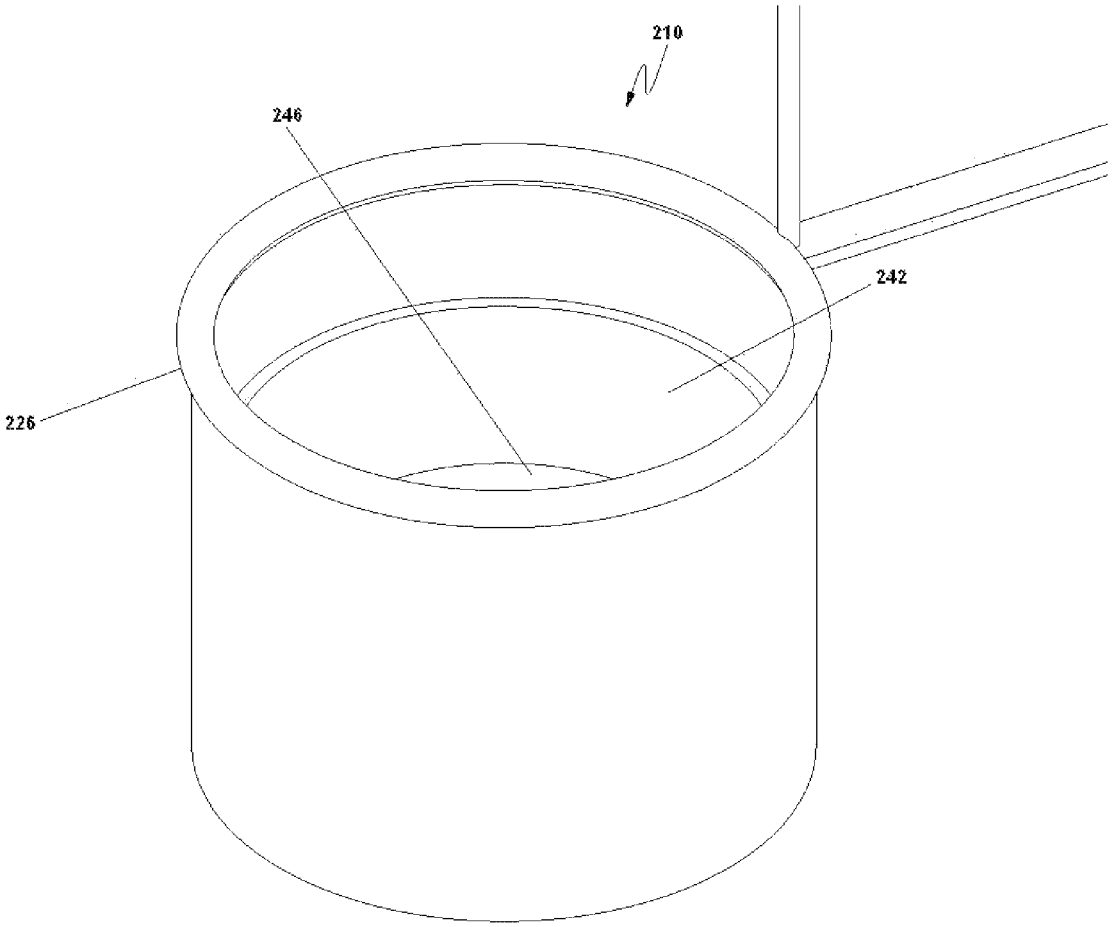
FIG. 12 is an up-close perspective view of the shuttlecock filter of the version shown in FIG. 7.
Figure 13:
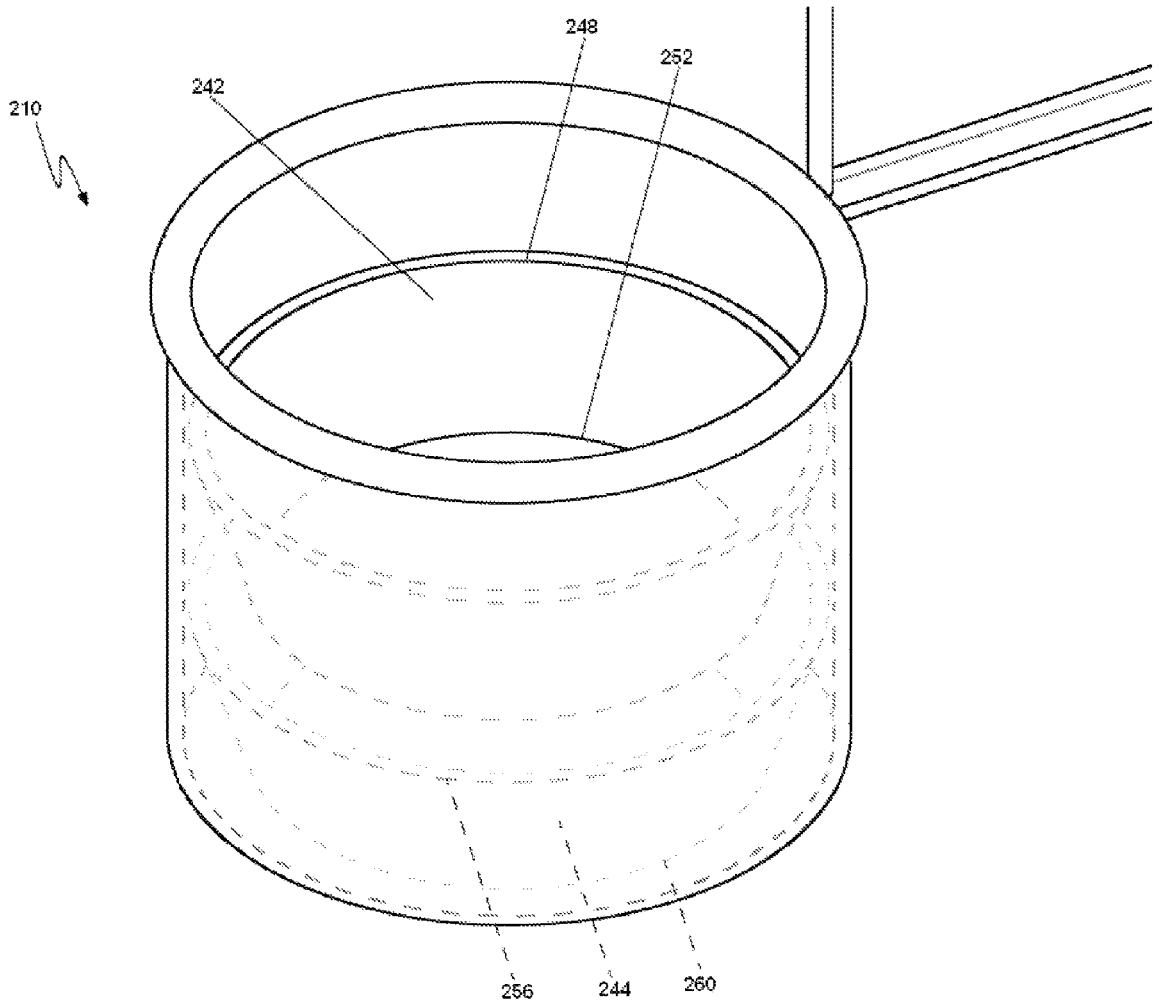
FIG. 13 is a up-close perspective view of the shuttlecock filter showing the upper and lower inner levels of the version shown in FIG. 7.
Figure 14A:
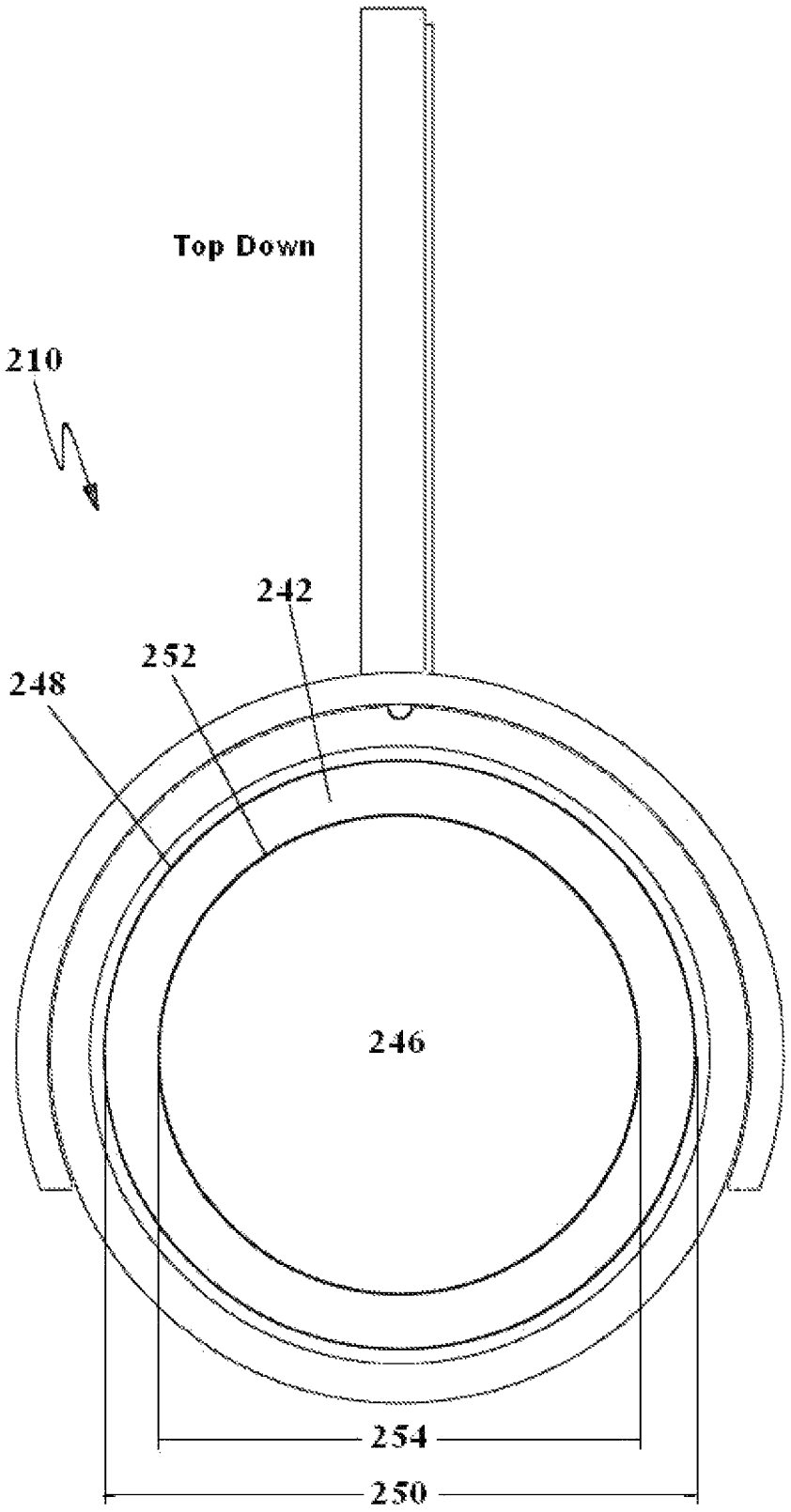
FIG. 14A is an up-close top plan view of the shuttlecock filter of the version shown in FIG. 7.
Figure 14B:
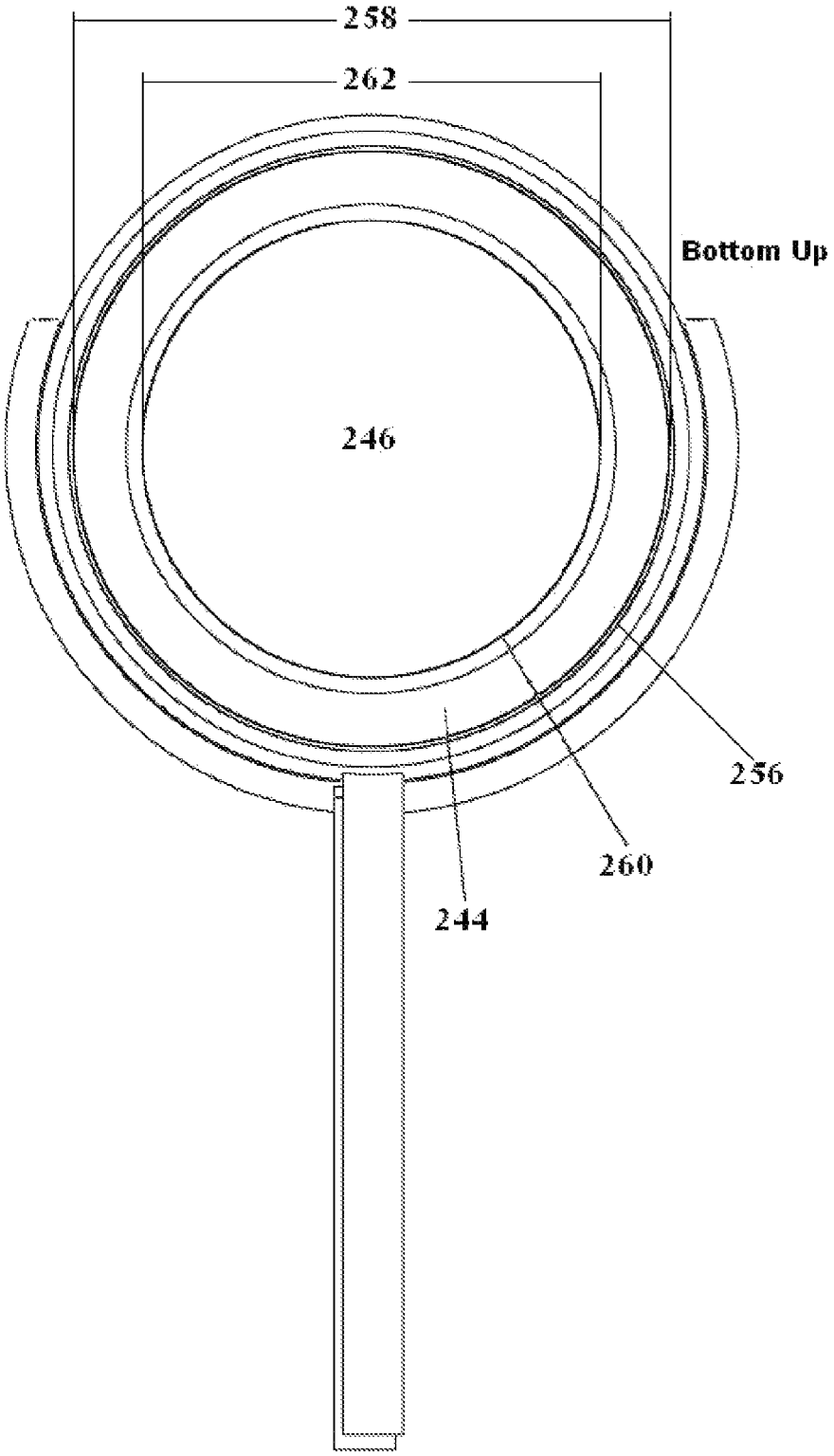
FIG. 14B is an up-close bottom plan view of the shuttlecock filter of the version shown in FIG. 7.

FIG. 11 is an up-close perspective view of the apparatus for applying a force 208 on the nested stack of one or more shuttlecocks 206 in a controlled, incremental manner. Preferably, the apparatus for applying a force is a crane assembly 232 which comprises a weight 234 attached to a cord 236 that is operably attached to a winding drum 238 or pulley which is controllably rotated by a second rotary actuator 240 and is rigidly attached to the vertical support member 218. The second rotary actuator 240 can be a digitally controlled continuous servomotor or the like and is operated by the programmable control system 30. The apparatus for applying a force 208 can be any controllable device that will apply a downward force to the center of the top of the stack of one or more shuttlecocks nested within the shuttlecock storage container 204.

FIG. 12-FIG. 17A of the version illustrate up-close depictions of the shuttlecock filter generally depicted as 210 and inner workings thereof. The shuttlecock filter 210 is for separating a single shuttlecock 10 from the entire stack of one or more shuttlecocks 206 held within the shuttlecock storage container 204. The shuttlecock filter 210 is adaptable to the bottom tube receiver and support 226. The shuttlecock filter 210 has an outer tubular shape similar in diameter as the shuttlecock storage container 204. The shuttlecock filter 210 is positioned to fit and align with the bottom of the shuttlecock storage container 204 while the shuttlecock storage container 204 is placed in the shuttlecock container holding assembly 224. While in this position, the shuttlecock filter 210 is ready to receive the bottom of the stack of one or more shuttlecocks from the shuttlecock storage container 204 in a linear manner.

The shuttlecock filter 210 comprises an filter level 242 and a lower suspending level 244 defining a filter channel 246. The filter level 242 is adapted to receive the bottom of the stack of the one or more shuttlecocks 206 from the shuttlecock storage container 204. The filter level 242 comprises a first circular upper opening 248 with a first diameter 250 and a lower circular opening 252 with a second diameter 254. Preferably, the first diameter 250 is approximately 2.5 inches and the second diameter 254 is 2 inches. The filter level 242 gradually narrows in diameter radially and longitudinally from the first circular upper opening 248 to the lower circular opening 252, wherein the lower circular opening 252 creates a ledge which separates the filter level 242 from the lower suspending level 244 of the shuttlecock filter 210.

The lower suspending level 244 is adapted to suspend a single shuttlecock 10 by its upper portion 16 which has been filtered from the stack of one or more shuttlecocks 206 by the filter level 242. The lower suspending level 244 comprises a similar radially narrowing of the diameter from top to bottom similar to the filter level 242. The lower suspending level 244 comprises a second circular upper opening 256 with a third diameter 258 and a lower opening 260 with a fourth diameter 262. Preferably, the third diameter 258 is approximately 2.5 inches and the fourth diameter 262 is 2 inches. The lower suspending level 244 gradually narrows in diameter radially and longitudinally from the second circular upper opening 256 to the lower opening 260, wherein the lower suspending level suspends a single shuttlecock 10 by its upper portion 16, wherein the shuttlecock 10 is ready to be retrieved.

Figure 15:
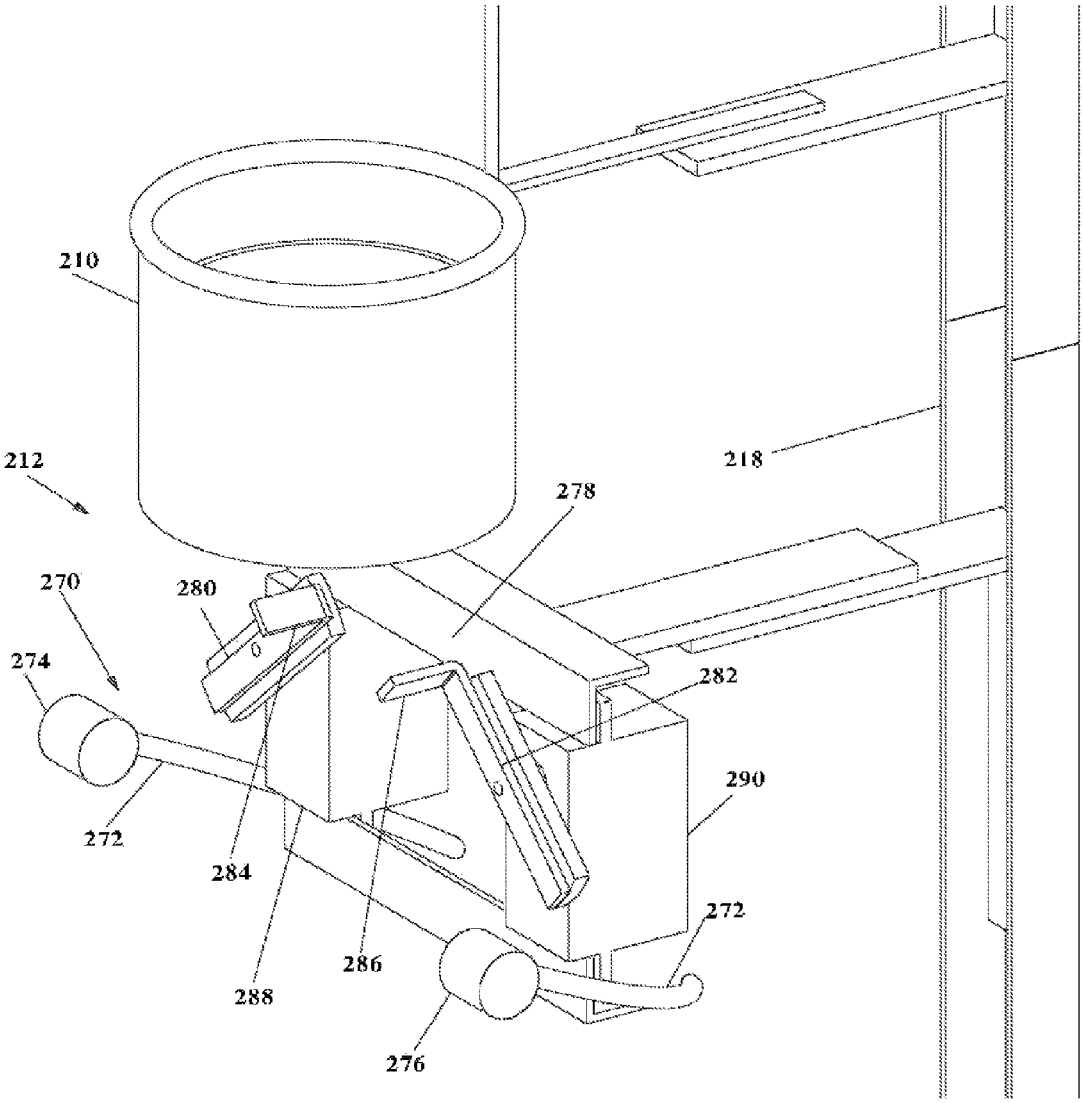
FIG. 15 is an up-close perspective view of the vertical shuttlecock transfer assembly shown in FIG. 7.
Figure 16:
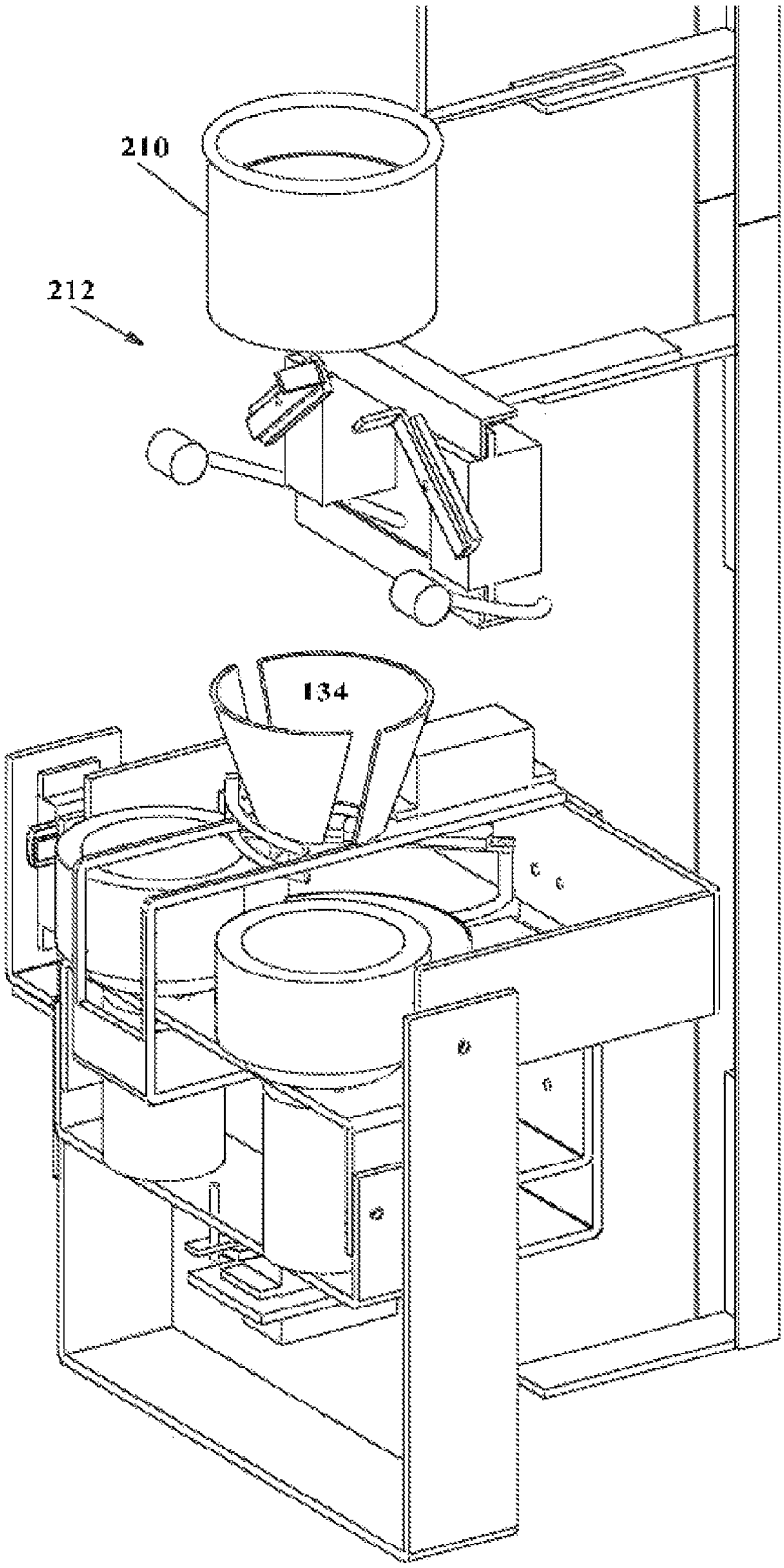
FIG. 16 is an up-close perspective view of the shuttlecock filter, vertical transfer assembly and the dual pivoting launch assembly of the version shown in FIG. 7.
Figure 17A:
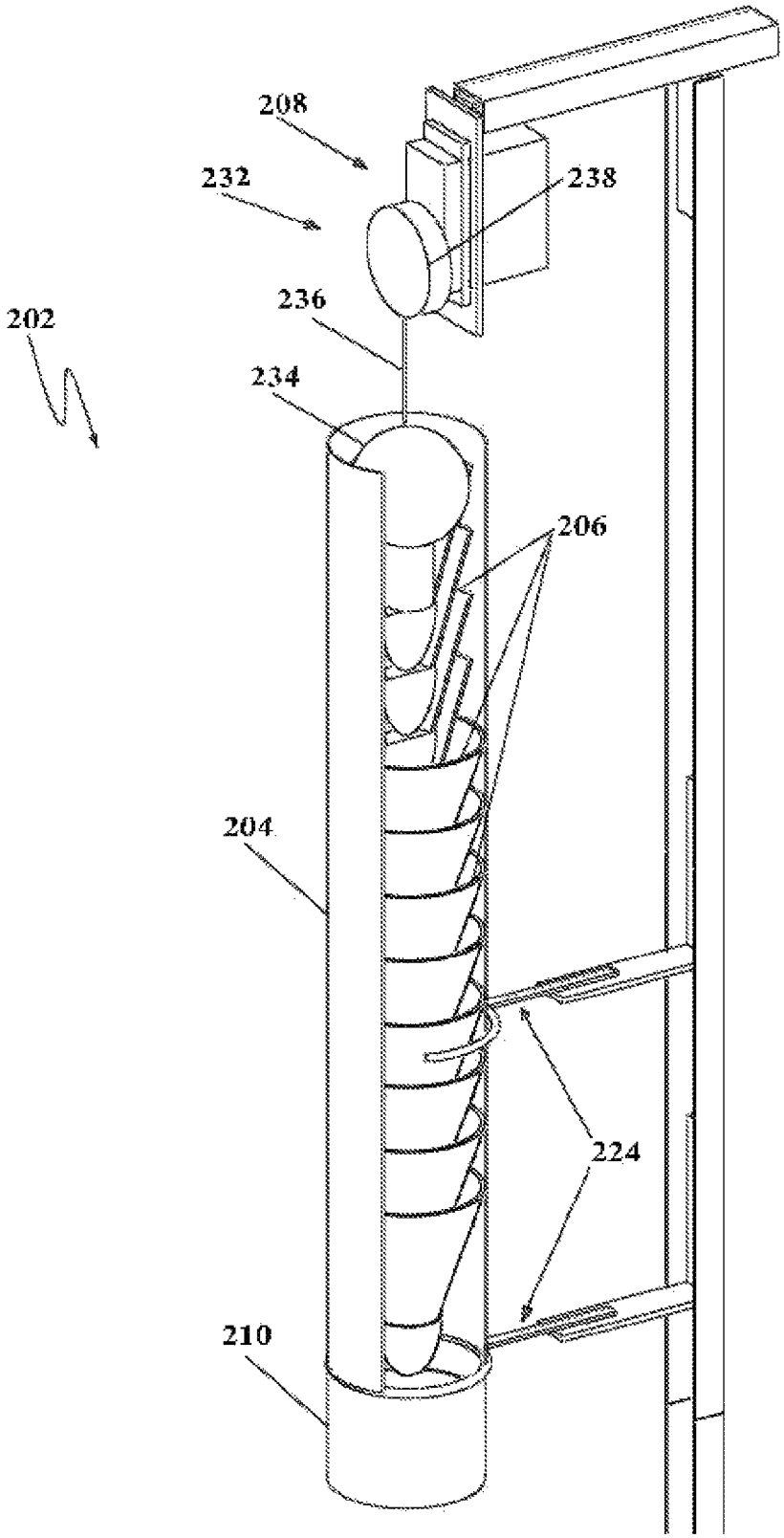
FIG. 17A is an illustrative perspective cut-away view of the apparatus for applying force providing a downward force to the stack of one or more shuttlecocks within the storage container of the version shown in FIG. 7.
Figure 17B:
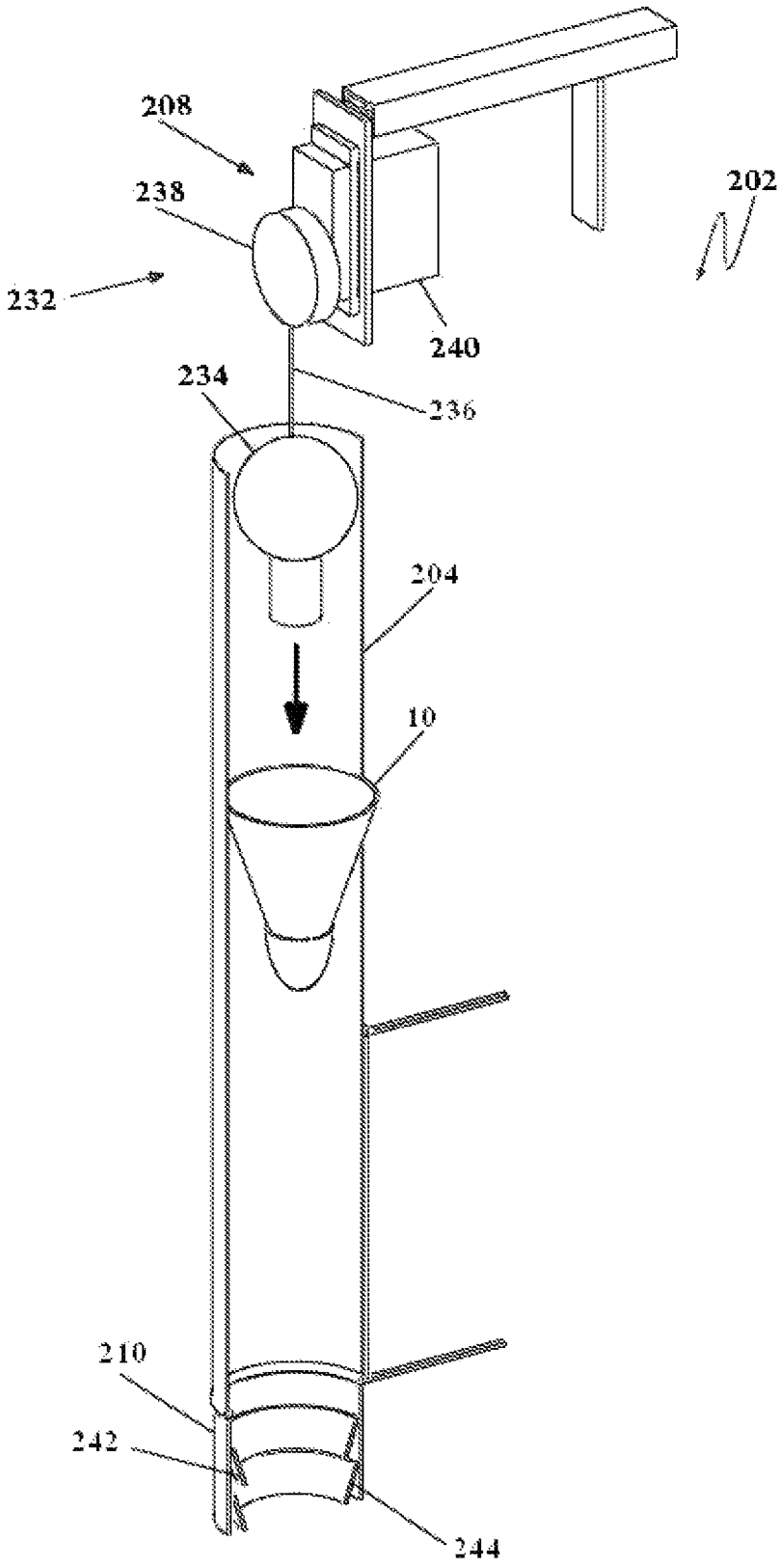
FIG. 17B is an illustrative perspective cut-away view illustrating a representative single shuttlecock within the stack of one or more shuttlecocks moving downward within the shuttlecock storage container of the version shown in FIG. 7.
Figure 17C:
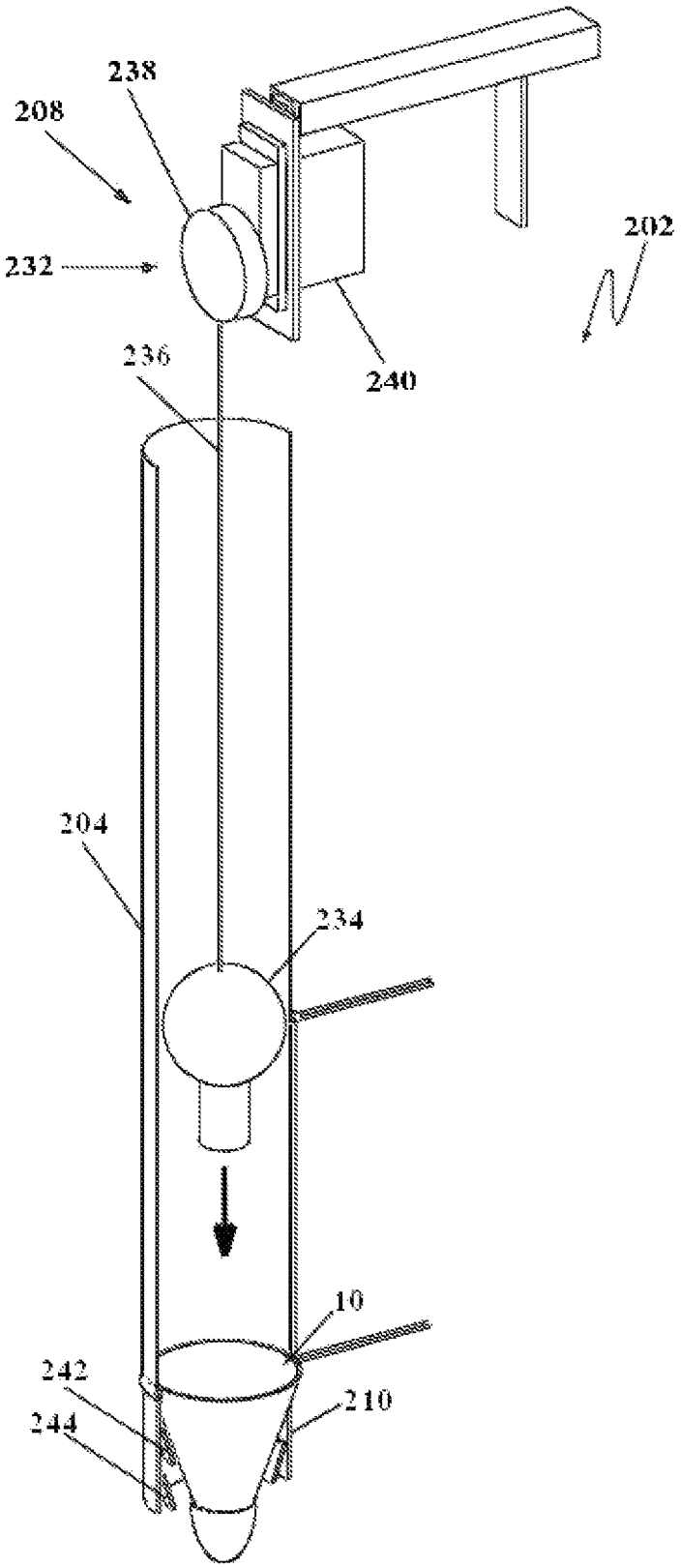
FIG. 17C is an illustrative perspective cut-away view illustrating the bottom shuttlecock of the stack of one or more shuttlecocks moving into the shuttlecock filter of the version shown in FIG. 7.

With reference to FIG. 15 and FIG. 16, the version further comprises a vertical shuttlecock transfer assembly generally depicted as 212 that is positioned immediately below the shuttlecock filter 210 and fixedly attached to the vertical support member 218. The purpose of the vertical shuttlecock transfer assembly 212 is to retrieve a suspended shuttlecock 10 from the shuttlecock filter 210 and transfer it to the holding area 134 in a controlled and queued manner. The vertical shuttlecock transfer assembly 212 comprises a means for detecting the presence of a suspended shuttlecock, which for purposes of this version is a LED light beam sensor 272 that emits a beam of light from a transmitter 274 to a receiver 276. Further, the vertical shuttlecock transfer assembly 212 comprises a grabber assembly which imparts the vertical transfer of the shuttlecock 10 from the lower suspending level 244 of the shuttlecock filter 210 to the holding area 134 of the shuttlecock holding and transfer assembly. Preferably the grabber assembly comprises a first arm 280 and second arm 282 with first and second grips 284 and 286 comprising the ability to rotate inward and downward in a mirrored fashion by one or more rotary actuators 288 and 290 such as a servomotor.

The basic method utilized by the shuttlecock distribution system 202 of separating a single shuttlecock from a stack of one or more shuttlecocks 206 as follows: providing a shuttlecock filter 210 comprising a narrowing diameter forming a filter channel 246; receiving the bottom of the stack of one or more shuttlecocks 206 within the shuttlecock filter 210; applying a force to the top of the stack of one or more shuttlecocks, wherein imparting movement of the stack towards and the bottom shuttlecock through the narrowing diameter until the top of the bottom shuttlecock passes through the shuttlecock filter 210, thereby separating the bottom shuttlecock from the remaining stack of one or more shuttlecocks; suspending the separated shuttlecock below the filter; and transferring and loading the suspended shuttlecock to the holding area 134 of the holding and transfer assembly 112.

Referring to FIG. 17A-FIG. 18C, the operation of the shuttlecock distribution system 202 is described in more detail. The basics of the operation of the shuttlecock distribution system 202 comprise loading of the stack of one or more shuttlecocks 206 within the shuttlecock storage container 204, filtering a single shuttlecock from the stack of one or more shuttlecocks by the shuttlecock filter 210, vertically transferring the single shuttlecock 10 to the holding area 134 of the shuttlecock holding and transfer assembly 112, and finally launching the single shuttlecock 10. This process may repeat itself until the stack of one or more shuttlecocks 206 contained within the shuttlecock storage container 204 are exhausted.

Figure 19:
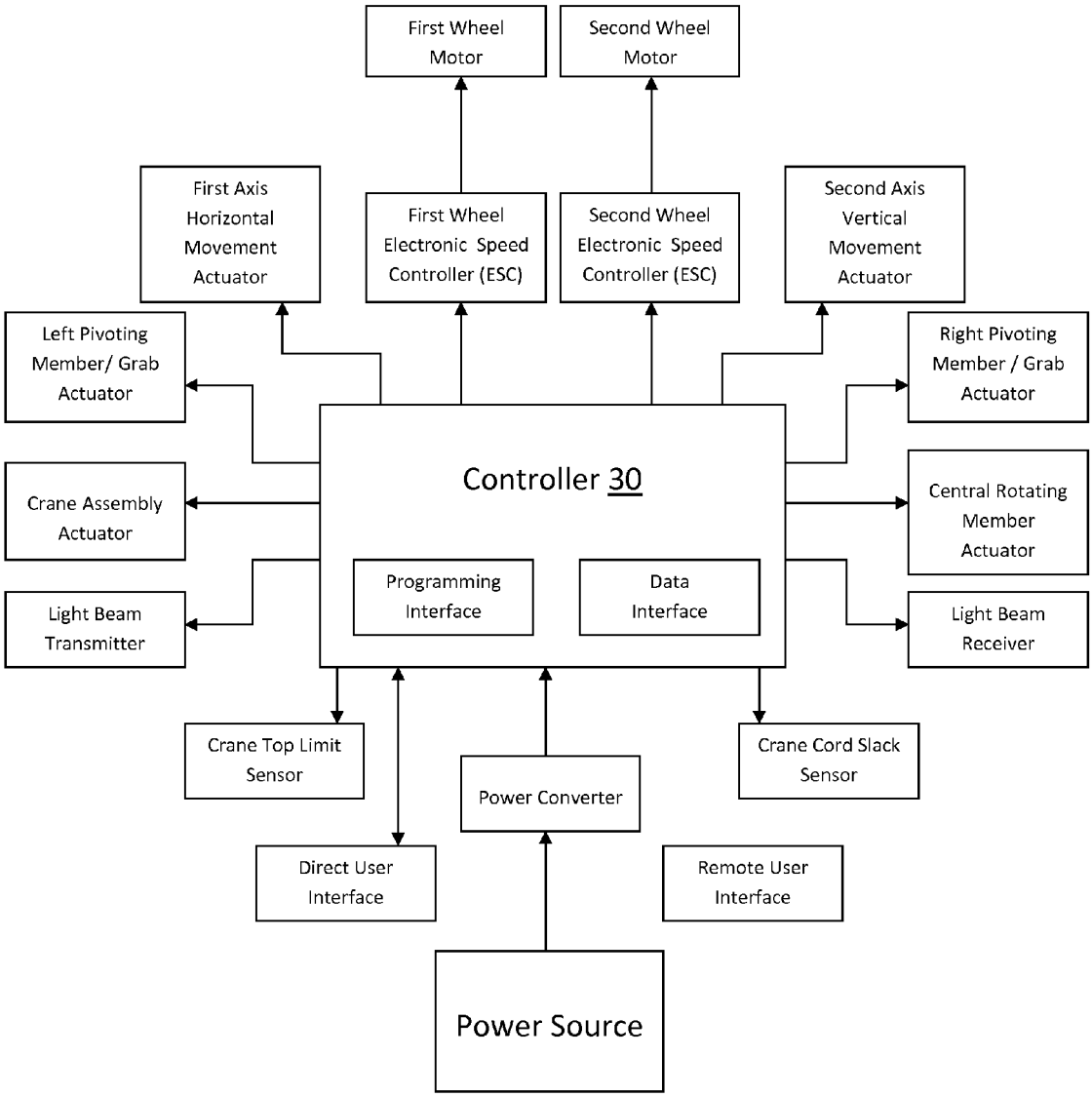
FIG. 19 is a block diagram of the programmable control system of the operation of the shuttlecock launcher.

The shuttlecock distribution system 202 can be controlled by a programmable control system 30 as depicted in FIG. 19 for coordinated operation and timing sequence of the shuttlecock distribution system components in order to separate and distribute a single shuttlecock to the holding area 134 from a stack of one or more shuttlecocks in a coordinated manner. The shuttlecock distribution system 202 can operate independently and in parallel with the controlled operation of the shuttlecock launching apparatus 100, thus reducing time between launches and facilitating the ability to provide increased shot frequency for top level players.

Figure 18A:
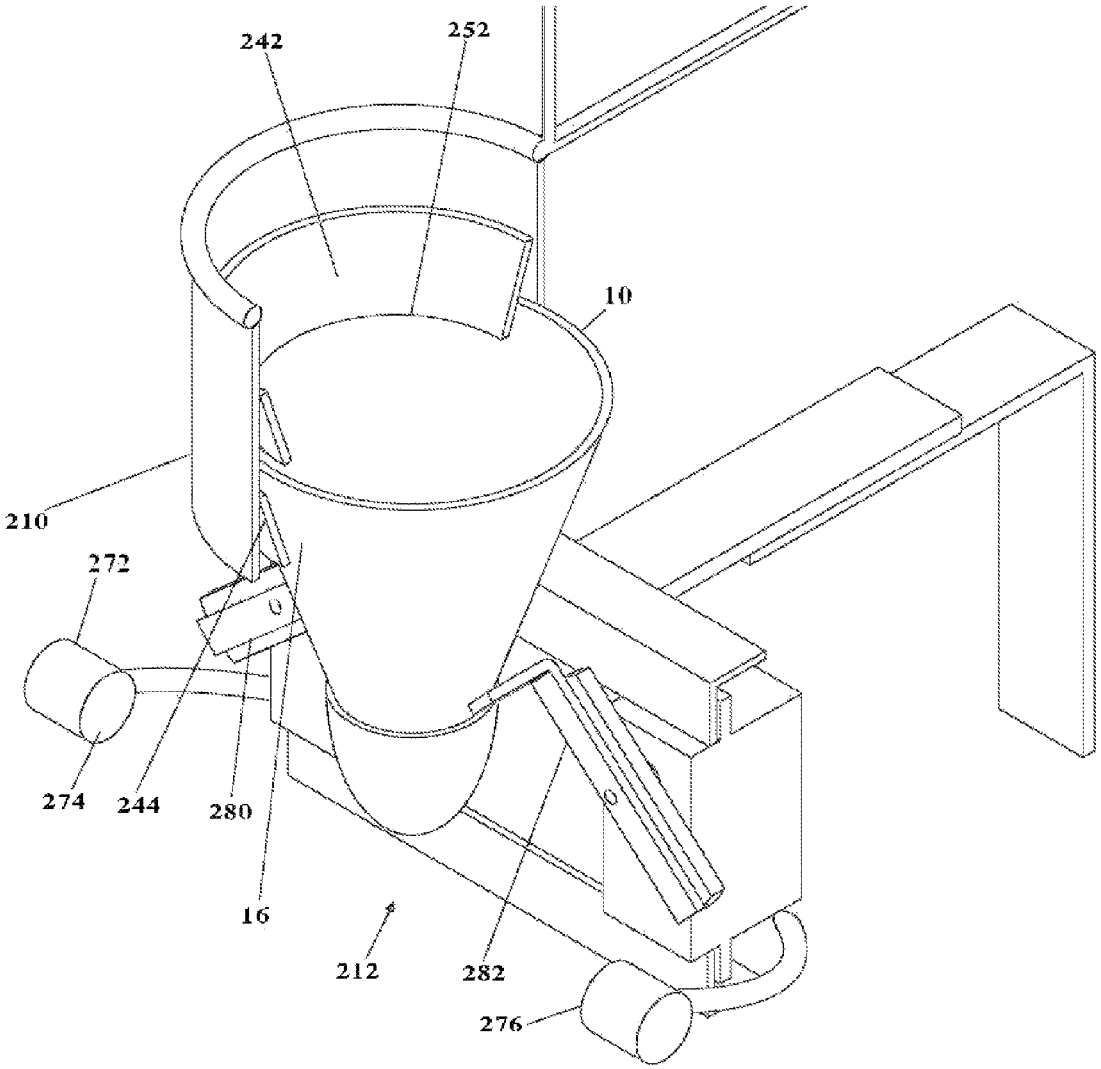
FIG. 18A is an illustrative perspective close-up cut away view of a shuttlecock passing through the shuttlecock filter and being retrieved by the grabber assembly of the version shown in FIG. 7.

In more detail, the loading and filtering of the stack of one or more shuttlecocks 206 in the version will be explained. Firstly, the loaded shuttlecock storage container 204 is engaged with the shuttlecock storage container holding assembly 224 and the shuttlecock filter 210 in a secure manner. Subsequently, the control system 30 engages the crane assembly 232 which lowers the weight 234 in a controlled manner via the cord 236, winding drum 238 (or pulley) and the second rotary actuator 240; thereby applying a downward force applied in a central manner to the stack of one or more shuttlecocks 206 nested within the shuttlecock storage container 204. As the downward force is being applied, the stack of one or more shuttlecocks 206 moves downward within the shuttlecock storage container 204. Concurrently, the bottom shuttlecock of the stack of one or more shuttlecocks 206 moves downward into the filter level 242 of the shuttlecock filter 210. As the bottom shuttlecock moves down through the shuttlecock filter 210, the narrowing diameter of the filter level 242 naturally squeezes the bottom shuttlecock into a smaller diameter until the shuttlecock passes the lower circular opening 252 which defines a ledge. At that point, as depicted in FIG. 18A, the bottom shuttlecock 10 separates from the stack of one or more shuttlecocks 206 and is now suspended by the upper portion 16 of the shuttlecock 10 by the narrowing diameter of the lower suspending level 244. The remaining stack of one or more shuttlecocks 206 maintains its position within the filter level 242 and the shuttlecock storage container 204.

Figure 18B:
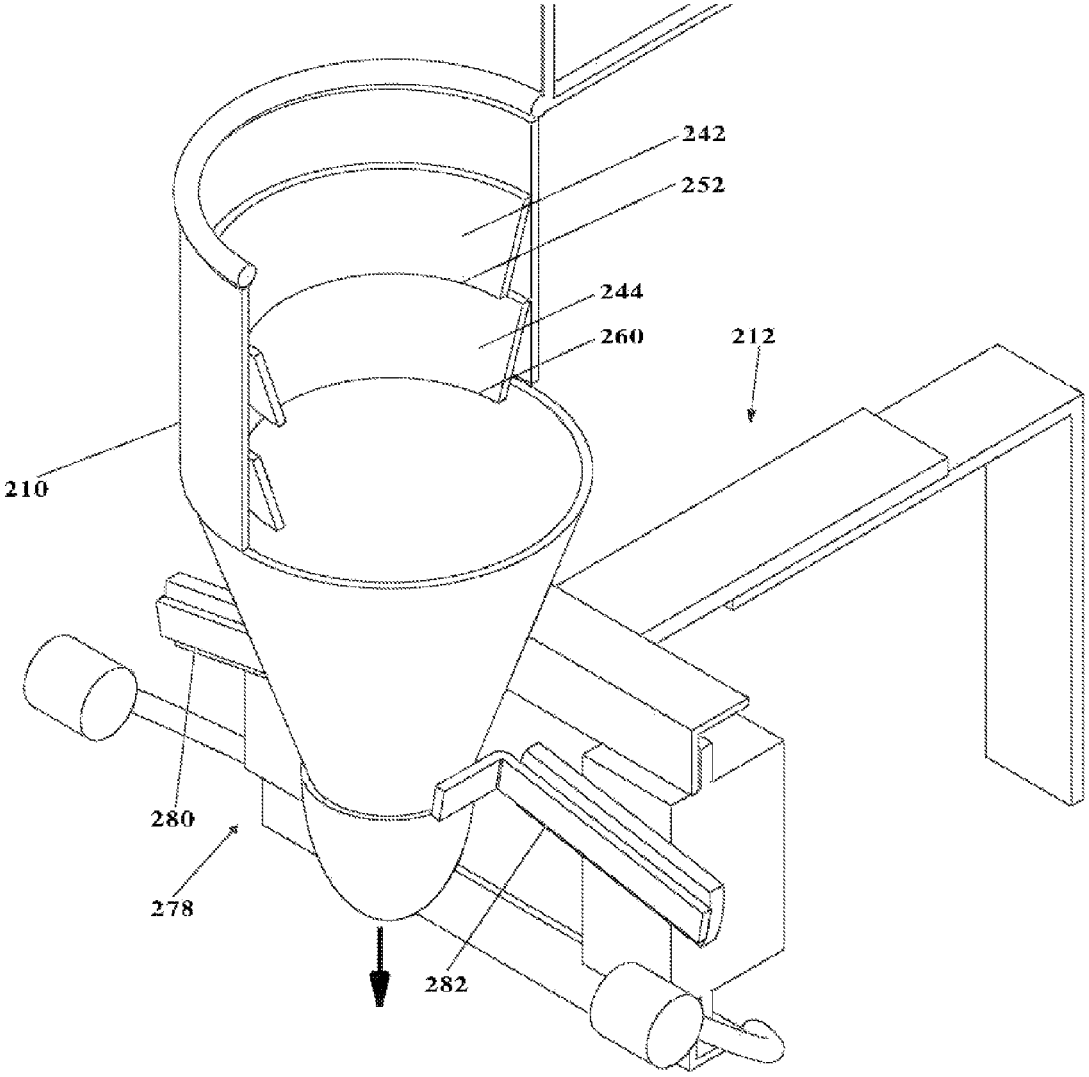
FIG. 18B is an illustrative perspective close-up view of a shuttlecock being retrieved and pulled down and away from the shuttlecock filter of the version shown in FIG. 7.
Figure 18C:
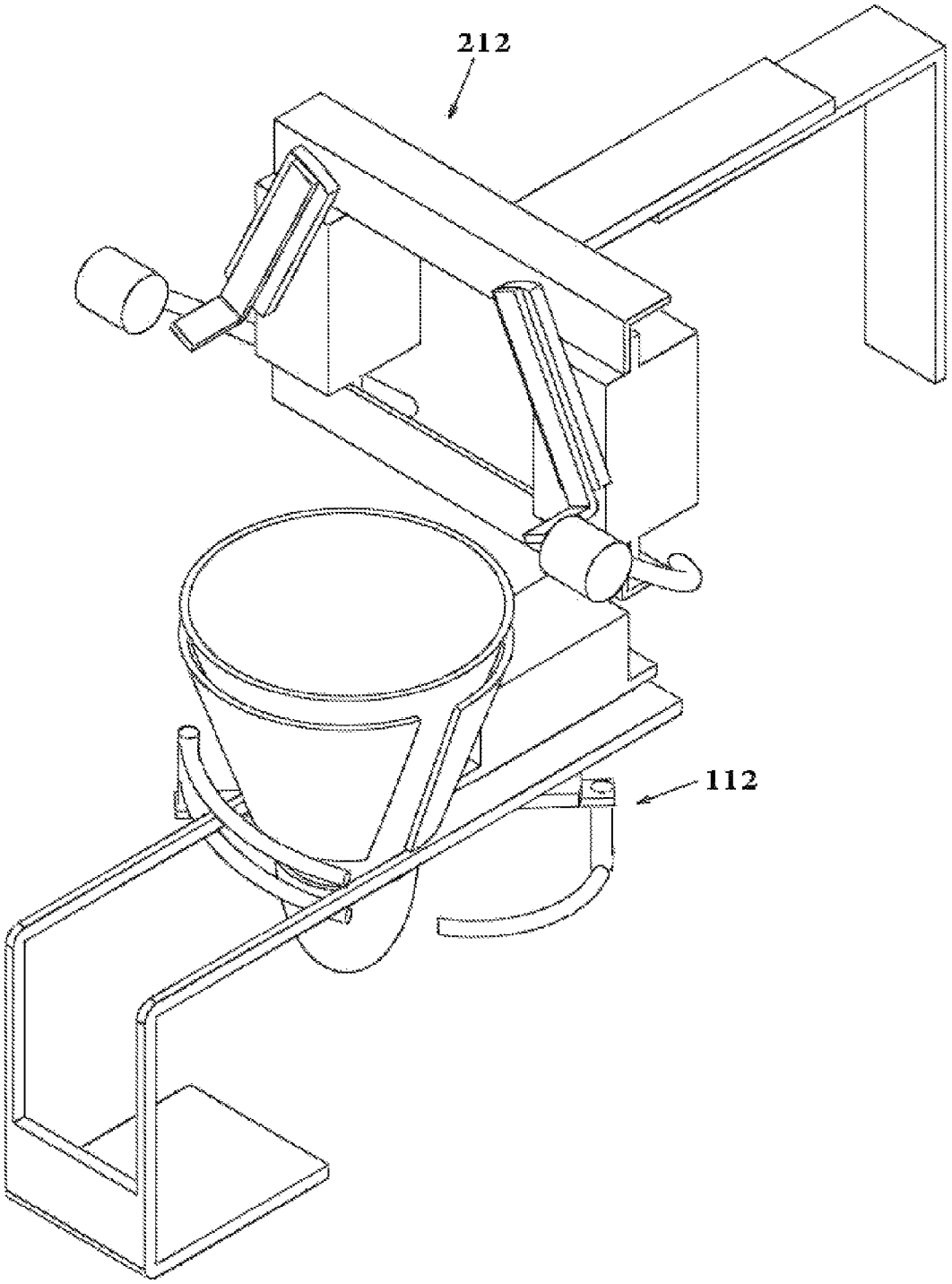
FIG. 18C is an illustrative perspective close-up view of a shuttlecock loaded into the shuttlecock holding and transfer assembly transferred from the vertical shuttlecock transfer assembly of the version shown in FIG. 7.

As depicted in FIG. 18A-FIG. 18C, the vertical transfer of the shuttlecock 10 by the vertical shuttlecock transfer assembly 212 will be described in more detail. When the separated single shuttlecock 10 moves into the suspended position created by the shuttlecock filter 210, it simultaneously triggers the means for detecting the presence of a shuttlecock or light beam sensor 272. The sensor 272 relays the signal to the programmable control system 30 which in turn signals the crane assembly 232 to discontinue the downward force applied by the weight 234 on the stack of one or more shuttlecocks 206 within the shuttlecock storage container 204. Concurrently, the control system 30 actuates the grabber assembly 278 of the vertical shuttlecock transfer assembly 212. Thus, the first and second arms 280 and 282 simultaneously rotate from top to bottom contacting and gripping the shuttlecock base 14, thus applying a downward force which releases the shuttlecock 10 from the shuttlecock filter 210 and is transferred down into the holding area 134 as depicted by FIG. 18C. At this point, the shuttlecock launcher of version 100 is in the loaded position and is launched in the manner described above. The control system 30 may repeat the sequence until the shuttlecocks are exhausted.

Once the shuttlecocks are exhausted, the shuttlecock distribution system 202 has the ability to detect the absence of shuttlecocks by a sensor that detects a slack in the cord that is created when the weight is at the bottom of the filter/storage container. At this point, the crane automatically retracts the weight until a sensor is triggered signaling that the weight is in the raised default position. Additionally, a weight lock can be utilized during storage to secure the weight from moving around or becoming loose.

Moreover, the version may provide the following features. Shuttles can easily wear and tear and can have broken feathers which frequently causes the stacked shuttlecocks to sometimes stick together or get stuck in the tube or filter. If such condition occurs, the crane assembly automatically detects and remedies the condition. In a version, a sensor detects a slack in the cord which—via the computer—signals the crane to raise and lower weight in a repeated and faster motion until the means for detecting a shuttlecock is triggered or until a predetermined number of attempts is reached. If the condition is not remedied the version automatically returns to the default raised position.

The present invention can be made in any manner and of any material chosen with sound engineering judgment such as plastics or metals, or a combination thereof. The materials may be strong, lightweight, long lasting, economic, and ergonomic. [More on materials]

Although preferred versions of the invention have been described in considerable detail, other versions and versions of the invention are possible. Therefore, the present invention should not be limited to the preferred versions described herein, but instead is defined by the spirit and scope of the appended claims.

The invention does not require that all the advantageous features and all the advantages need to be incorporated into every version of the invention.

All features disclosed in this specification including any claims, abstract, and drawings may be replaced by alternative features serving the same, equivalent or similar purpose unless expressly stated otherwise.

What is claimed is:

1. A shuttlecock launcher for launching a shuttlecock at various trajectories, velocities, spins and shot types, comprising:

(a) a dual pivoting launch assembly comprising a launch point for launching shuttlecocks at a plurality of launch angles;

(b) first and second launching wheels having identical planes and axes of rotation mounted on the dual pivoting launch assembly disposed about the launch point; and (c) a shuttlecock holding and transfer assembly mourned on the dual pivoting launch assembly for receiving, holding, and transferring a single shuttlecock to said first and second launching wheels in a controlled manner comprising:

(i) a holding area having a conical shape approximating the conical shape of a shuttlecock operably configured for receiving and seating a single shuttlecock in an upright position while the dual pivoting launch assembly moves to the launch angle, the holding area comprising a rear fixed portion and a front gate portion, wherein the front gate portion being configured to move in a path of motion having at least an open position and a closed position;

(ii) a pair of laterally disposed guidance supports fixedly extending from the holding area to the launch point, the pair of guidance supports laterally spaced to accommodate the movement and width of the shuttlecock, wherein providing lateral support to opposing sides of the shuttlecock in order to maintain an upright position while the shuttlecock is moving from the holding area to at least the launch point; and (iii) a shuttlecock transfer mechanism for transferring the shuttlecock from the holding area to the launch point along and between the pair of guidance supports, wherein the shuttlecock transfer mechanism comprises a curved rear thrust member configured to rotate in a horizontal lane behind the shuttlecock which imparts forward motion simultaneous the front gate portion moves into the open position, thereby as the curved rear thrust member rotates behind the shuttlecock it accelerates the shuttlecock forward.

2. The shuttlecock launcher of claim 1, further comprising a programmable control system coupled to the dual pivoting launch assembly, first and second launch wheels, and the holding and transfer assembly for controlling at least one of a launch angle, first and second launching wheels, and activation timing of the operation of the holding and transfer assembly, wherein the launch angle, independent velocities of the first and second launch wheels, and activation timing selected from predetermined parameters defining the trajectory of a launched shuttlecock for an intended simulated shot.

3. The shuttlecock launcher of claim 2, further comprising first and second fenders adjacent to the first and second launching wheels for providing a barrier to prevent the shuttlecock from contacting the first and second launching wheels before the shuttlecock reaches the launch point.

4. The shuttlecock launcher of claim 1, wherein the shuttlecock transfer mechanism further comprises a central rotating member rigidly connecting the front gate portion with the rear thrust member rotatable about a first axis, the central rotating member configured to rotate in a path of motion that simultaneously moves the front gate portion to the open position and moves the rear thrust, member to the shuttlecock providing a forward thrust, thereby transferring the shuttlecock from the holding area to the launch point.

5. The shuttlecock launcher of claim 4, wherein the shuttlecock transfer mechanism further comprises a lower shuttlecock support member configured to add support to the cork base of a loaded shuttlecock within the holding area, wherein the lower shuttlecock support member is rigidly connected to the central rotating member.

6. A shuttlecock launcher for launching a shuttlecock at various trajectories, velocities, and shot types comprising:

(a) a tubular shuttlecock storage container capable of housing a stack of one or more shuttlecocks comprising a top and bottom openings and having diameter approximate the maximum diameter of the cone shaped top of a shuttlecock, wherein the storage container supports the stack of one or more shuttlecocks in a normal position relative to the bottom opening;

(b) an apparatus for applying a controlled force on the stack of one or more shuttlecocks within the shuttlecock storage container, wherein the applied controlled force is biased centrally downward applied to the vertically aligned and stacked cork bases relative to the shuttlecock storage container, the apparatus for applying a controlled force on the stack of one or more shuttlecocks comprising a weight, a cord, and a motor for suspending,lifting and lowering the weight in a controlled manner, whereby during operation, the weight is lowered providing a downward force to the stack of one or more shuttlecocks in a controlled, incremental manner;

(c) a shuttlecock filter located at the bottom opening of the shuttlecock storage container for receiving and separating the bottom shuttlecock from the stack of one or more shuttlecocks as the stack of one or more shuttlecocks moves downward within the shuttlecock storage container, the shuttlecock filter comprising:

(i) a filter level comprising a circular upper opening with a first diameter and a lower opening with a second diameter, wherein the first diameter is approximate the maximum diameter of the cone shaped top of a shuttlecock and the second diameter is less than the first diameter, wherein the filter level narrows from the first diameter the second diameter, the filter level is adapted to receive the bottom opening, of the tubular shuttlecock storage and the stack of the one or more shuttlecocks including a bottom shuttlecock wherein during operation the narrowing of the diameter of the filter level squeezes the bottom shuttlecock of the stack of one or more shuttlecocks into a smaller diameter until the top of the bottom shuttlecock passes below the second diameter, thereby separating the bottom shuttlecock from the remaining stack of one or more shuttlecocks; and (ii) a lower suspending level for suspending the separated bottom shuttlecock below the filter level, wherein the lower suspending level narrows in diameter concentric to the cone shaped top of the shuttlecock;

(d) a dual pivoting launch assembly comprising a launch point for launching shuttlecocks at a plurality of launch angles;

(e) first and second launching wheels mounted on the dual pivoting launch assembly;

(f) a holding and transfer assembly mounted on the dual pivoting launch assembly adjacent to the first and second launch wheels for receiving, holding and transferring a single shuttlecock to the first and second launching wheels in a controlled manner comprising:

(i) a holding area for receiving and seating a single shuttlecock in an upright position; and (ii) a shuttlecock transfer mechanism for transferring the shuttlecock in one linear movement from the holding area to the launch point; and (g) a vertical shuttlecock transfer assembly for transferring a single shuttlecock from the shuttlecock filter to the holding area in a controlled manner.

7. The shuttlecock launcher of claim 6, further comprising a programmable control system coupled to the dual pivoting launch assembly, first and second launch wheels, and the holding and transfer assembly for controlling at least one of the launch angle, the independent velocities of the first and second launch wheels, and activation timing of the operation of the holding and transfer assembly, wherein the launch angle, the independent velocities of the first and second launch wheels, and activation timing selected from predetermined parameters defining the trajectory of a launched shuttlecock for an intended simulated shot, programmable control system fluffier coupled to the apparatus for applying a force and the vertical shuttlecock transfer assembly for coordinating the operation of separating a single shuttlecock from the stack of One or more Shuttlecocks and transferring the single shuttlecock to the bolding area of the holding and transfer assembly.

8. The shuttlecock launcher of claim 7, wherein the vertical shuttlecock transfer assembly comprises:

(a) a means for detecting the presence of a shuttlecock; and (b) a grabber assembly, the grabber assembly comprising first and second pivoting members for simultaneously gripping and pulling down opposing sides of the cork base of the shuttlecock, thereby transferring a separated shuttlecock from the lower suspending level of the shuttlecock filter to the holding and transfer assembly.

9. The shuttlecock launcher of claim 8, wherein the means for detecting, the presence of a shuttlecock is a light beam sensor, the light beam sensor positioned to detect the presence of a shuttlecock.

10. The shuttlecock launcher of claim 6, wherein the vertical shuttlecock transfer assembly comprises:

(a) a means for detecting the presence of a shuttlecock; and (b) a grabber assembly, the grabber assembly comprising a first and second pivoting members for simultaneously gripping and pulling down opposing sides of the cork base of the shuttlecock, thereby transferring a separated shuttlecock from the filter to said holding and transfer assembly.

11. A shuttlecock launcher for launching a shuttlecock at various trajectories and velocities, comprising:

(a) a tubular shuttlecock storage container capable of housing a stack of one or more shuttlecocks comprising a top and bottom openings and having a diameter approximate the maximum diameter of the cone shaped top of a shuttlecock, wherein the storage container supports the stack of one or more shuttlecocks in a normal position relative to the bottom opening;

(b) an apparatus for applying a controlled force on the stack of one or more shuttlecocks for providing a downward movement of the one or more shuttlecocks within the shuttlecock storage container, wherein the applied controlled force is biased centrally downward applied to the vertically aligned and stacked cork bases relative to the shuttlecock storage container, the apparatus for applying a controlled force on the stack of one or more shuttlecocks comprising a weight, a cord; and a motor for suspending, lifting and lowering, the weight in a controlled manner, whereby during operation, the weight is lowered providing a downward force to the stack of one or more shuttlecocks in controlled, incremental manner;

(c) a shuttlecock filler located at the bottom opening of the shuttlecock storage container for receiving and separating the bottom shuttlecock from the stack of one or more shuttlecocks as the stack of one or more shuttlecocks moves downward within the shuttlecock storage container, the shuttlecock filter comprises a filter level comprising a circular upper opening with a first diameter and a lower opening with a second diameter, wherein the second diameter is less than the first diameter, wherein the filter level narrows from the first diameter to the second diameter, the filter level is adapted to receive the bottom of the stack of the one or more shuttlecocks, whereby the narrowing of the diameter of the filter level squeezes the bottom shuttlecock of the stack of one or more shuttlecocks into a smaller diameter until the top of the bottom shuttlecock passes below the second diameter, thereby separating the bottom shuttlecock from the remaining stack of one or more shuttlecocks; and a lower suspending level for suspending the separated bottom shuttlecock below the filter level, wherein the lower suspending level narrows in diameter concentric to the cone shaped top of the shuttlecock;

(d) a dual pivoting launch assembly comprising a launch point for launching shuttlecocks at a plurality of launch angles;

(e) first and second launching wheels having identical planes and axes of rotation mounted on the dual pivoting launch assembly disposed about the launch point, wherein the first and second launching wheels are variable speed and counter rotating for performing the launching of the shuttlecock;

(f) a holding and transfer assembly mounted on the dual pivoting launch assembly fixedly positioned before and relative to the first and second launch wheels for receiving, holding and transferring a single shuttlecock to the launch point in a controlled manner, comprising a holding area haying a conical body approximating the conical shape of a shuttlecock operably configured for receiving and holding a shuttlecock in an upright position, wherein the holding area secures the shuttlecock in position while the dual pivoting launch assembly moves to the launch angle; a pair of disposed guidance supports aligned in a horizontal plane which is parallel to the launch angle and perpendicular to the axis of rotation of the launching wheels, the pair of disposed guidance supports spaced apart to accommodate the width of the cone of the shuttlecock above the cork base; and a shuttlecock transfer mechanism for transferring the shuttlecock from the holding area along the shuttlecock guidance supports to the launch point; and (g) a vertical shuttlecock transfer assembly for transferring a single shuttlecock from the shuttlecock filter to said holding area in a controlled manner, the vertical shuttlecock transfer assembly comprising a means for detecting the presence of a shuttlecock and a grabber assembly, the grabber assembly comprising, a first and second pivoting members for simultaneously gripping and pulling down opposing sides of the cork base of the shuttlecock, thereby transferring a separated shuttlecock from the filter to said holding and transfer assembly.

12. A shuttlecock distribution system comprising:

(a) a tubular shuttlecock storage containers capable of housing a stack of one or more shuttlecocks comprising a top and bottom openings, and having a diameter approximate the maximum diameter of the cone shaped top of the shuttlecock, wherein the storage container supports the stack of one or more shuttlecocks in a normal position relative to the bottom opening;

(b) an apparatus for applying a controlled force on the stack of one or more shuttlecocks providing a downward movement of the one or more shuttlecocks within the shuttlecock storage container, wherein the applied controlled force is biased centrally downward applied to the vertically aligned and stacked cork bases relative to the shuttlecock storage container, the apparatus for applying a controlled force on the stack of one or more shuttlecocks comprising a weight; a cord; and a motor for spending, lifting and lowering the weight in a controlled manner, whereby during operation, the weight is lowered providing a downward force to the stack of one or more shuttlecocks in a controlled incremental manner; and (c) a shuttlecock filter located at the bottom opening of the shuttlecock storage container for receiving and separating the bottom shuttlecock from the stack of one or more shuttlecocks as the stack of one or more shuttlecocks moves downward within the shuttlecock storage container the shuttlecock filter comprising:

(i) a filter level comprising a circular upper opening with a first diameter and a lower opening with a second diameter, wherein the first diameter is approximate the maximum diameter of the top a shuttlecock and the second diameter is less than the first diameter, wherein the filter level narrows from the first diameter to the second diameter, the filter level is adapted to receive the bottom opening of the tubular shuttlecock storage and the stack of the one or more shuttlecocks including a bottom shuttlecock wherein during operation the narrowing of the diameter of the filter level squeezes the bottom shuttlecock of the stack of one air more shuttlecocks into a smaller diameter top of the bottom shuttlecock passes below the second diameter, thereby separating the bottom shuttlecock from the remaining stack of one or more shuttlecocks; and (ii)a lower suspending level for suspending the separated bottom shuttlecock below the filter level, wherein the lower suspending level narrows in diameter concentric to the cone shaped top of the shuttlecock.

13. A method for separating a single bottom shuttlecock from a stack of one or more shuttlecocks comprising:

(a) providing a shuttlecock filter comprising (i)a filter level comprising a circular upper opening with a first diameter and a lower opening with a second diameter, wherein the first diameter is approximate the maximum diameter of the cone shaped top of a shuttlecock and the second diameter less than the first diameter, wherein the filter level narrows from the first diameter to the second diameter, the filter level is adapted to receive the bottom opening of the tubular shuttlecock storage and the stack of one or more shuttlecocks including a bottom shuttlecock, and (ii) a lower suspending level for suspending the separated bottom shuttlecock below the filter level, wherein the lower suspending level narrows in diameter concentric to the cone shaped top of the shuttlecock;

(b) providing an apparatus for applying a controlled force on the stack of one or more shuttlecocks comprising a weight, a cord, and a motor for suspending, lifting and lowering the weight in a controlled manner;

(c) receiving the bottom of the stack of one or more shuttlecocks within the filter;

(d) applying a force to the top of the stack of one or more shuttlecocks, by the apparatus for applying a controlled force, wherein imparting movement of the bottom shuttlecock through the narrowing diameter of the filter level, squeezing the bottom shuttlecock in a smaller diameter until the top of the bottom shuttlecock passes below the second diameter, thereby separating the bottom shuttlecock from the remaining stack of one or more shuttlecocks; and (e) suspending the separated bottom shuttlecock below the filter by the lower suspending level.

14. A method for launching a single shuttlecock comprising:

(a) providing a dual pivoting launch assembly comprising a launch point for launching shuttlecocks at a plurality of launch angles;

(b) providing a first and second launching wheels having identical planes and axes of rotation;

(c) providing a holding and transfer assembly comprising:

(i) a holding area haying a conical body approximating the conical shape of a shuttlecock operably configured for receiving and holding a single shuttlecock in an upright position while the dual pivoting launch assembly moves the launch male, the holding area comprising a rear fixed portion and a front gate portion, wherein the front gate portion being configured to move in a path of motion having a least an open position and a closed position;

(ii) a pair of laterally disposed guidance supports fixedly extending from the holding area to the launch point, the pair of guidance supports laterally spaced to accommodate the movement and width of the shuttlecock, wherein providing lateral support to opposing sides of the shuttlecock in order to maintain an upright position while the shuttlecock is moving from the holding area to at least the launch point; and (iii) a shuttlecock transfer mechanism for transferring the shuttlecock from the holding area to the launch point, wherein the shuttlecock transfer mechanism comprises a curved rear thrust member configured to rotate in a horizontal plane behind the shuttlecock which imparts forward motion simultaneous the front gate portion moves into the open position;

(d) loading a single shuttlecock within the holding area of the holding and transfer assembly;

(e) moving the dual pivoting launch assembly to a desired launch angle;

(f) shuttlecock transfer mechanism transferring the single shuttlecock to the first and second launching wheels, wherein the shuttlecock transfer mechanism moves the shuttlecock forward, suspended within the pair of disposed guidance supports to the launch point, wherein immediately prior to reaching the launch point, the cork base of the shuttlecock is suspended immediately behind the first and second launching wheels aligned perpendicular to the axes of rotation and in the plane of the launch wheels; and (g) first and second launching wheels launching the single shuttlecock along a launch path.

15. The method for launching a single shuttlecock of claim 14, further comprising:

(a) providing a shuttlecock filter comprising a narrowing diameter forming a filter channel;

(b) receiving the bottom of the slack of one or more shuttlecocks within the filter;

(c) applying, a force to the top of the stack of one or more shuttlecocks, wherein imparting movement of the bottom shuttlecock through the narrowing diameter, until the top of the bottom shuttlecock passes through the shuttlecock filter, thereby separating the bottom shuttlecock from the remaining stack of one or more shuttlecocks;

(d) suspending the separated shuttlecock below the filter; and (e) transferring and loading the suspended shuttlecock to the holding area of the holding and transfer assembly.

* * * * *